US007817110B2

(12) United States Patent
Hwang et al.

(10) Patent No.: US 7,817,110 B2
(45) Date of Patent: Oct. 19, 2010

(54) PLASMA DISPLAY APPARATUS HAVING ENHANCED DISCHARGE STABILITY AND DRIVING THEREOF

(75) Inventors: Dooyong Hwang, Yongin-si (KR); Dong Hwan Lee, Busan-si (KR)

(73) Assignee: LG Electronics Inc., Seoul (KR)

( * ) Notice: Subject to any disclaimer, the term of this patent is extended or adjusted under 35 U.S.C. 154(b) by 984 days.

(21) Appl. No.: 11/634,121

(22) Filed: Dec. 6, 2006

(65) Prior Publication Data

US 2007/0285352 A1 Dec. 13, 2007

(30) Foreign Application Priority Data

Jun. 13, 2006 (KR) ..... 10-2006-0053210

(51) Int. Cl.
*G09G 3/28* (2006.01)

(52) U.S. Cl. ..... 345/60; 345/690

(58) Field of Classification Search ..... 345/60, 345/690

See application file for complete search history.

(56) References Cited

U.S. PATENT DOCUMENTS

| | | | | |
|---|---|---|---|---|
| 6,621,230 | B2 * | 9/2003 | Lim et al. | 315/169.3 |
| 2001/0020923 | A1 * | 9/2001 | Homma | 345/60 |
| 2003/0011542 | A1 | 1/2003 | Nakamura | 345/63 |
| 2003/0030599 | A1 * | 2/2003 | Kim | 345/60 |
| 2004/0021656 | A1 * | 2/2004 | Kang et al. | 345/204 |
| 2005/0035931 | A1 * | 2/2005 | Yoo et al. | 345/63 |
| 2005/0225504 | A1 | 10/2005 | Kim | 345/60 |
| 2005/0264479 | A1 | 12/2005 | Ito et al. | 345/60 |

(Continued)

FOREIGN PATENT DOCUMENTS

CN 1759072 A 4/2006

(Continued)

OTHER PUBLICATIONS

The Commission of the European Communities: "Commission Decision of Aug. 18, 2005, Amending Directive 2002/95/EC of the European Parliament and the Council for the purpose of establishing the maximum concentration values for certain hazardous substances in electrical and electronic equipment" Official Journal of the European Union, Aug. 19, 2005; <URL:http://leadfree.ipc.org/files/mcvs.pdf> (XP002453506).

(Continued)

*Primary Examiner*—Richard Hjerpe
*Assistant Examiner*—Andrew Schnirel
(74) *Attorney, Agent, or Firm*—KED & Associates, LLP

(57) ABSTRACT

Provided is a plasma display apparatus and a method of driving the same. The plasma display apparatus includes a scan driver. The scan driver supplies a first driving signal to the scan electrode in a first subfield during a first reset period, a first address period, and a first sustain period. The scan driver supplies a second driving signal to the scan electrode, during a second reset period having a different time duration from the first reset period, a second address period having a different time duration from the first address period, and a second sustain period having a different time duration from the first sustain period. At least one of the dielectric layer or the protective layer includes 1000 PPM (parts per million) or less of lead(Pb).

26 Claims, 25 Drawing Sheets

U.S. PATENT DOCUMENTS

| | | | | |
|---|---|---|---|---|
| 2006/0033682 | A1* | 2/2006 | Choi | 345/60 |
| 2006/0050094 | A1* | 3/2006 | Ishii et al. | 345/690 |

FOREIGN PATENT DOCUMENTS

| | | | |
|---|---|---|---|
| EP | 1 136 975 | A1 | 9/2001 |
| EP | 1 398 756 | A2 | 3/2004 |
| EP | 1 626 389 | A2 | 2/2006 |
| EP | 1 657 702 | A2 | 5/2006 |
| JP | 12-053443 | | 2/2000 |
| KR | 10-2001-0037562 | A | 5/2001 |
| KR | 10-2002-0085704 | A | 11/2002 |
| KR | 10-2005-0110947 | | 11/2005 |
| WO | WO 2004/114271 | A1 | 12/2004 |

OTHER PUBLICATIONS

European Search Report Apr. 10, 2008.
Chinese Office Action dated Jun. 13, 2008.

* cited by examiner (a)

(b)

PLASMA DISPLAY APPARATUS HAVING ENHANCED DISCHARGE STABILITY AND DRIVING THEREOF

This Nonprovisional application claims priority under 35 U.S.C. §119(a) on Patent Application No. 10-2006-0053210 filed in Korea on Jun. 13, 2006, the entire contents of which are hereby incorporated by reference.

BACKGROUND

1. Field

This document relates to a plasma display apparatus and driving thereof.

2. Background

In general, a plasma display apparatus comprises a plasma display panel with a plurality of electrodes, and a driver for driving the electrodes of the plasma display panel.

The plasma display panel comprises the plurality of electrodes, and the driver supplies a driving voltage for inducing a discharge to the electrodes of the plasma display panel. Thus, the driving voltage induces the discharge, such as a reset discharge, an address discharge, and a sustain discharge, within a discharge cell of the plasma display panel.

In general, in the plasma display panel, a phosphor layer is provided within the discharge cell partitioned by barrier ribs, and the plurality of electrodes is provided. A driving signal is supplied to the discharge cell through the plurality of electrodes.

The driving signal supplied to the discharge cell induces the discharge. When the driving signal induces the discharge within the discharge cell, a discharge gas filled in the discharge cell generates vacuum ultraviolet rays, and the generated vacuum ultraviolet rays excite phosphors provided within the discharge cell, and generate visible rays. By the generated visible rays, an image is displayed on a screen of the plasma display panel.

The plasma display panel has a drawback that a discharge characteristic varies depending on capacitance. In detail, it has a drawback that, when the plasma display panel increases in capacitance, a discharge firing voltage increases within the discharge cell and thus, the discharge characteristic is unstabilized such as weakening of a discharge intensity.

SUMMARY

In one general aspect, there is provided an apparatus and method for driving a plasma display panel comprising a scan electrode, a dielectric layer, and a protective layer. The apparatus comprises a scan driver. The scan driver supplies a first driving signal to the scan electrode in a first subfield during a first reset period for initializing a discharge cell, a first address period for scanning the discharge cell, and a first sustain period for sustaining a discharge of the discharge cell. The scan driver supplies a second driving signal different from the first driving signal to the scan electrode, during a second reset period having a different time duration from the first reset period, a second address period having a different time duration from the first address period, and a second sustain period having a different time duration from the first sustain period. At least one of the dielectric layer or the protective layer comprise 1000 PPM (parts per million) or less of lead(pb).

Further features will be apparent from the following description, including the drawings, and the claims.

BRIEF DESCRIPTION OF THE DRAWINGS

The invention will be described in detail with reference to the following drawings in which like numerals refer to like elements.

DETAILED DESCRIPTION

Figure 1:
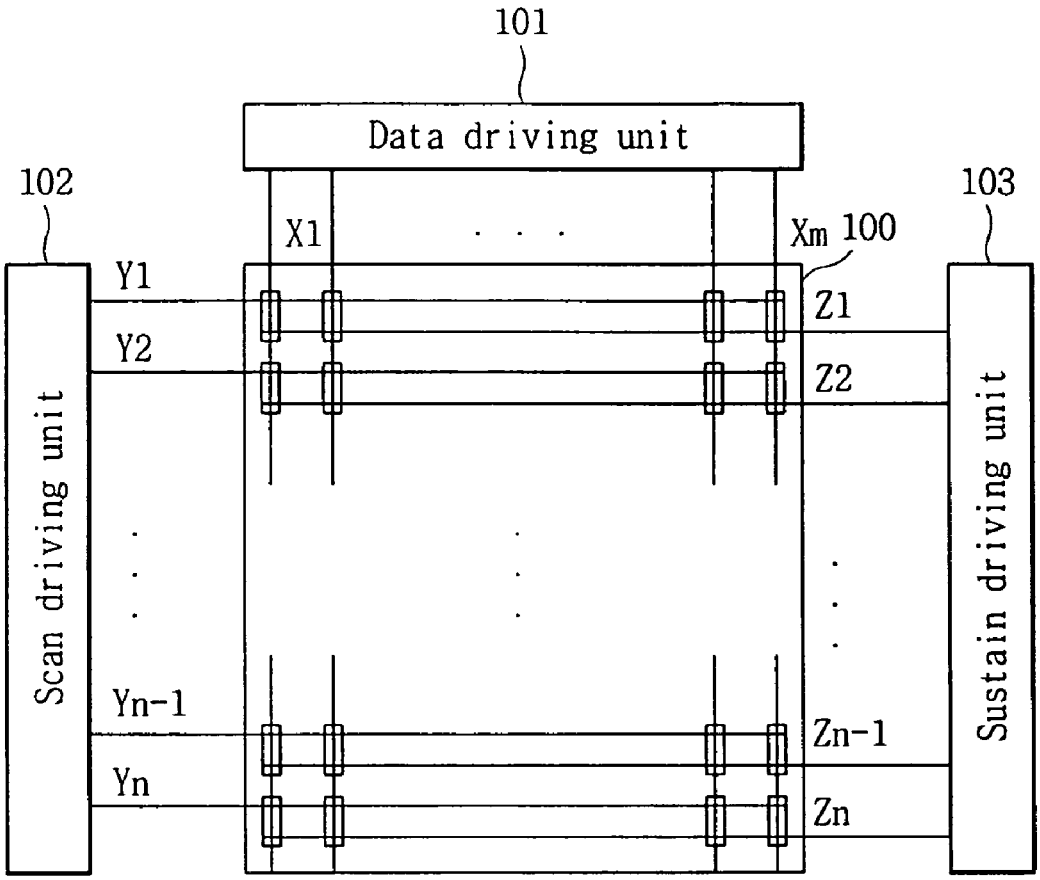
FIG. 1 is a schematic view illustrating an implementation of a plasma display apparatus.

Preferred embodiments of the present invention will be described in a more detailed manner with reference to the drawings.

In one aspect, there is provided a method for driving a plasma display panel comprising a scan electrode, a dielectric layer, and a protective layer. The method comprises: supplying a first driving signal to the scan electrode in a first subfield during a first reset period for initializing a discharge cell, a first address period for scanning the discharge cell, and a first sustain period for sustaining a discharge of the discharge cell; and supplying a second driving signal different from the first driving signal to the scan electrode in a second subfield during a second reset period having a different time duration from the first reset period, a second address period having a different time duration from the first address period, and a second sustain period having a different time duration from the first sustain period, wherein at least one of the dielectric layer or the protective layer comprise 1000 PPM (parts per million) or less of lead(pb).

The first subfield may be at least one of a plurality of subfields, and the second subfield may be at least one of the plurality of the subfields other than the subfields of the first subfield.

A width of a first reset signal of the first driving signal supplied to the scan electrode during the first reset period may be different from a width of a second reset signal of the second driving signal supplied to the scan electrode during the second reset period.

A width of a first setup signal of the first reset signal may be different from a width of a second setup signal of the second reset signal.

Maximum voltages of the first setup signal and the second setup signal may have range from 250V to 350V.

A width of a first setdown signal of the first reset signal may be different from a width of a second setdown signal of the second reset signal.

Minimum voltages of the first setdown signal and the second setdown signal may range from −210V to −140V.

A first frame may comprise the first subfield comprising the first reset signal. A second frame may comprise the second subfield comprising the second reset signal. A gray level weight of the first subfield may be substantially equal to a gray level weight of the second subfield.

The number of first reset signals supplied to the scan electrode during the first reset period of the first subfield may be different from the number of second reset signals supplied to the scan electrode during the second reset period of the second subfield.

A second reset signal supplied to the scan electrode during the second reset period of the second subfield may comprise either a setup signal and a setdown signal or a bias signal sustained at a first voltage.

The first voltage may be substantially equal to a scan reference voltage supplied to the scan electrode during the address period of the second subfield.

A plurality of sustain signals may be supplied to a sustain electrode during the second sustain period of the second subfield. A first sustain signal among the plurality of second sustain signals supplied to the scan electrode during the second sustain period of the second subfield may overlap with a first sustain signal among the plurality of sustain signals supplied to the sustain electrode.

The second reset signal may comprise the bias signal sustained at the first voltage, during the second reset period of the second subfield. A falling slope of the last sustain signal among a plurality of sustain signals supplied to the scan electrode in a subfield earlier than the second subfield may be substantially equal to a falling slope of the setdown signal supplied to the scan electrode during a setdown period.

A width of a first scan signal supplied to the scan electrode during the first address period of the first subfield may be different from a width of the second scan signal supplied to the scan electrode during the second address period of the second subfield.

Minimum voltages of the first scan signal and the second scan signal may range from −250V to −150V.

A first frame may comprise the first subfield comprising the first scan signal. A second frame may comprise the second subfield comprising the second scan signal. A gray level weight of the first subfield may be substantially equal to a gray level weight of the second subfield.

The number of first scan signals and the number of second scan signals may be plural. A width of each of the first scan signals may be different from a width of each of the second scan signals.

The number of first sustain signals supplied to the scan electrode during the first sustain period of the first subfield and the number of second sustain signals supplied to the scan electrode during the second sustain period of the second subfield may be plural. A width of at least one of the first sustain signals may be different from a width of at least one of the second sustain signals.

An n-th subfield of a first frame may comprise the first subfield. An n-th subfield of a second frame may comprise the second subfield. The number of first sustain signals supplied to the scan electrode during the first sustain period may be different from the number of second sustain signals supplied to the scan electrode during the second sustain period.

Maximum voltages of a first sustain signal and a second sustain signal may range from 150V to 250V.

In another aspect, there is provided a plasma display apparatus. The apparatus comprises a scan electrode, a dielectric layer, a protective layer, and a scan driver. The scan driver supplies a first driving signal to the scan electrode in a first subfield during a first reset period for initializing a discharge cell, a first address period for scanning the discharge cell, and a first sustain period for sustaining a discharge of the discharge cell, and supplies a second driving signal different from the first driving signal to the scan electrode, during a second reset period having a different time duration from the first reset period, a second address period having a different time duration from the first address period, and a second sustain period having a different time duration from the first sustain period, wherein at least one of the dielectric layer and the protective layer comprise 1000 PPM (parts per million) or less of lead(pb).

There may be a first temperature in the first subfield of the plasma display panel. There may be a second temperature in the second subfield of the plasma display panel. The first temperature in the first subfield may be more than the second temperature in the second subfield. In the second subfield, the time duration of the second reset period may be less than the time duration of the first reset period, the time duration of the second address period may be less than the time duration of the first address period, and the time duration of the second sustain period may be less than the time duration of the first sustain period.

A method for driving a plasma display panel of the present invention will be in detail described with reference to the attached drawings below.

FIG. 1 is a schematic view illustrating a plasma display apparatus.

As shown in FIG. 1, the plasma display apparatus comprises a plasma display panel 100 and a scan driver 102. The plasma display apparatus can further comprise a sustain driver 103, and a data driver 101.

The plasma display panel 100 comprises scan electrodes (Y1 to Yn), sustain electrodes (Z1 to Zn), and address electrodes (X1 to Xm). A more detailed description thereof will be made with reference to FIGS. 2A and 2B.

The scan driver 102 supplies a driving signal, such as a reset signal, a scan signal, and a sustain signal, to the scan electrodes (Y1 to Yn) of the plasma display panel 100.

The scan driver 102 differentiates time durations of a reset period, an address period, and a sustain period depending on a subfield, and supplies the driving signal. In a detailed description, the scan driver 102 supplies a first driving signal to the scan electrodes (Y1 to Yn) in a first subfield during a first reset period for initializing a discharge cell, a first address period for scanning the discharge cell, and a first sustain period for sustaining a discharge of the discharge cell. The scan driver 102 supplies a second driving signal to the scan electrodes (Y1 to Yn) in a second subfield during a second reset period having a different time duration from the first reset period, a second address period having a different time duration from the first address period, and a second sustain period having a different time duration from the first sustain period.

A more detailed description will be made in FIG. 3 below.

The sustain driver 103 supplies a driving signal, such as a sustain bias voltage and the sustain signal, to the sustain electrodes (Z1 to Zn) of the plasma display panel 100.

The data driver 101 supplies an image data signal that is a conversion signal of an image signal supplied from the exterior, to the address electrodes of the plasma display panel 100.

FIG. 1 illustrates that the scan driver 102 and 202, the sustain driver 103 and 203, and the data driver 101 and 213 are of board types different from each other. However, at least two of the scan driver 102 and 202, the sustain driver 103 and 203, and the data driver 101 and 213 can be integrated in one board type.

Figure 2A:
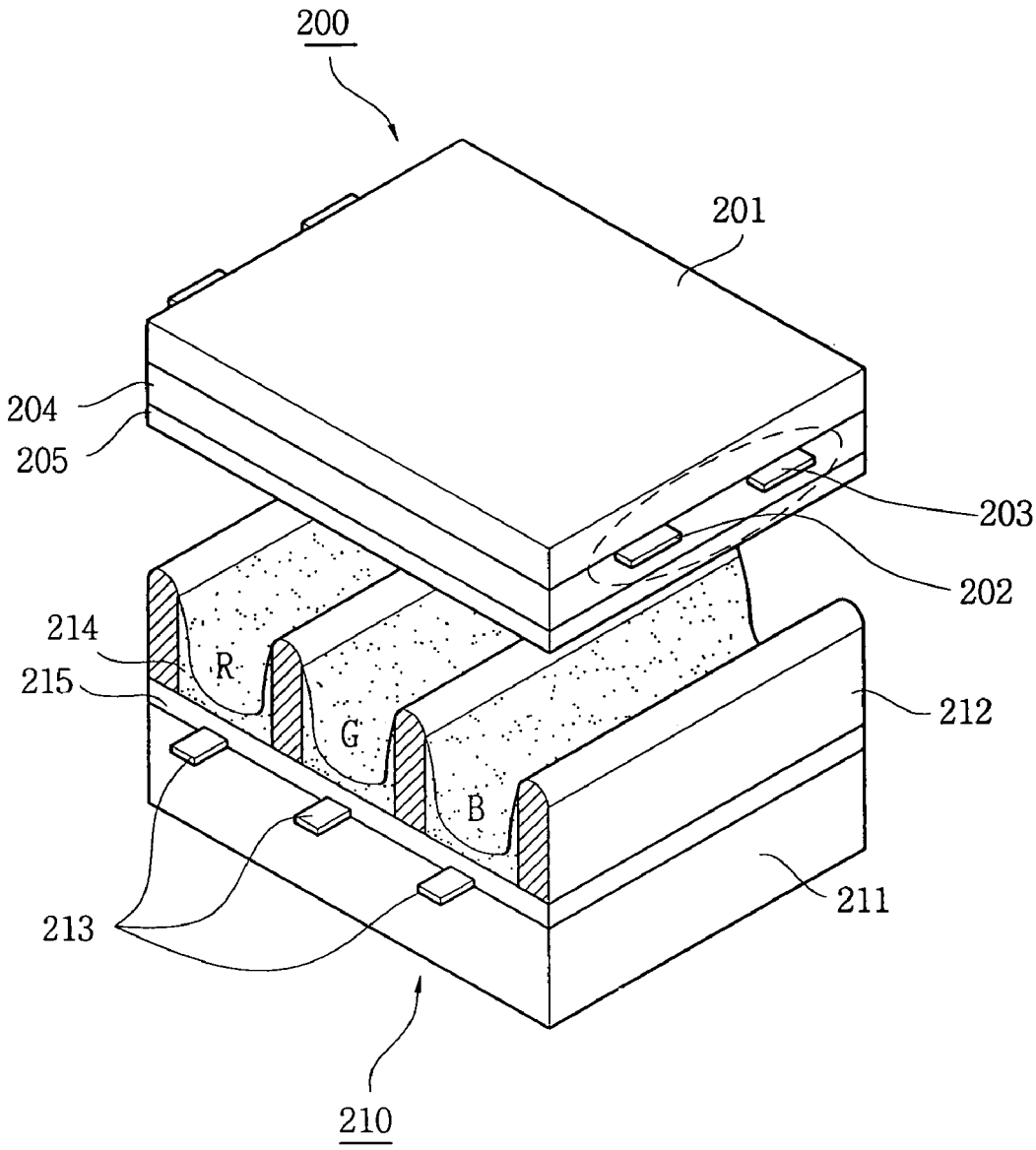
FIGS. 2A and 2B illustrate an implementation of a plasma display panel based on a driving method of the plasma display panel.
Figure 2B:
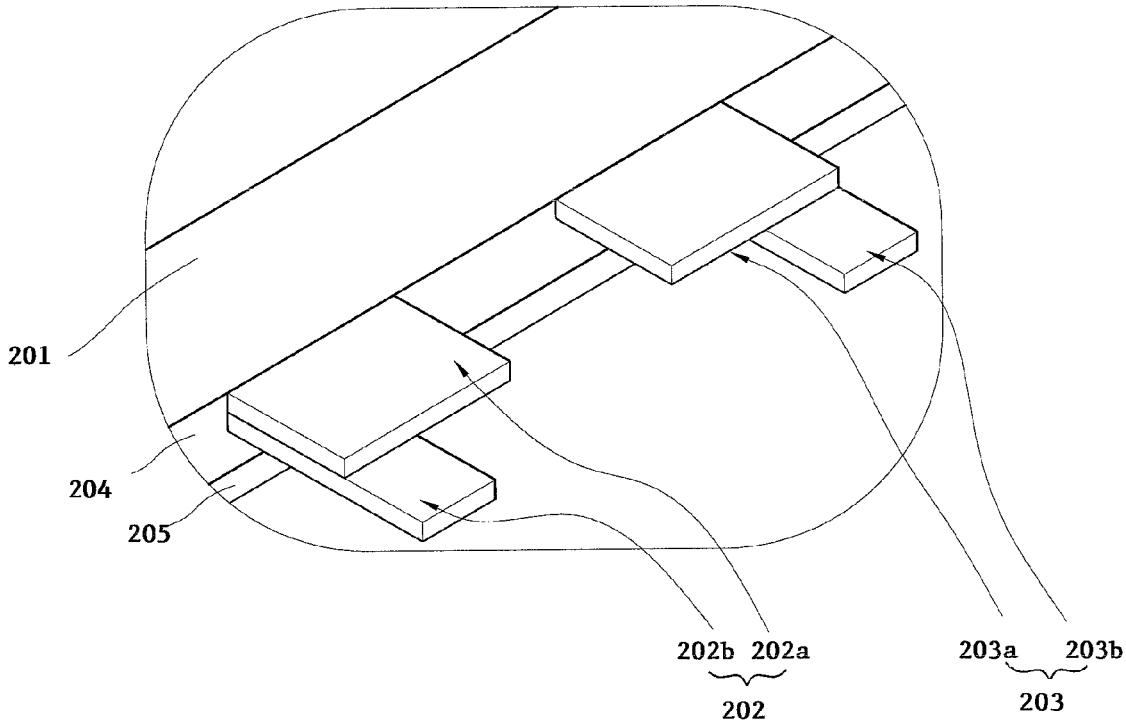

FIGS. 2A and 2B illustrate an implementation of the plasma display panel.

First, referring to FIG. 2A, the plasma display panel 100 of the present invention is formed by adhering a front panel 200 and a rear panel 210. The front panel 200 comprises a front substrate 201 in which the scan electrode (Y) 202 and the sustain electrode (Z) 203 are formed in parallel with each other. The rear panel 210 comprises a rear substrate 211 in which the address electrodes (X) 213 intersects with the scan electrode (Y) 202 and the sustain electrode (Z) 203.

The scan electrode (Y) 202 and the sustain electrode (Z) 203 provided on the front substrate 201 induce the discharge in a discharge space, that is, in the discharge cell and at the same time, sustain the discharge of the discharge cell.

An upper dielectric layer 204 is formed on the front substrate 201 having the scan electrode (Y) 202 and the sustain electrode (Z) 203, and covers the scan electrode (Y) 202 and the sustain electrode (Z) 203.

The upper dielectric layer 204 limits a discharge current of the scan electrode (Y) 202 and the sustain electrode (Z) 203, and provides insulation between the scan electrode (Y) 202 and the sustain electrode (Z) 203.

A protective layer 205 is formed on the upper dielectric layer 204, and facilitates a discharge condition. The protective layer 205 is formed using a method for depositing material such as oxide magnesium (MgO) on the upper dielectric layer 204.

The address electrode (X) 213 formed on the rear substrate 211 is an electrode for supplying a data signal to the discharge cell.

A lower dielectric layer 215 is formed on the rear substrate 211 having the address electrode (X) 213, and covers the address electrodes (X) 213.

The lower dielectric layer 215 insulates the address electrodes (X) 213 with each other.

Barrier ribs 212 of a stripe shape, a well shape, a delta shape, and a honeycombed shape are provided on the lower dielectric layer 215, and partition the discharge cell that is the discharge space. Thus, the Red (R), Green (G), and Blue (B) discharge cells are provided between the front substrate 201 and the rear substrate 211.

The discharge cells partitioned by the barrier ribs 212 are filled with a predetermined discharge gas.

Phosphor layers 214 are provided within the discharge cells partitioned by the barrier ribs 212, and emit visible rays for displaying the image at the time of address discharge. For example, R, G, B phosphor layers can be formed.

In the above described plasma display panel 100 of the present invention, when the driving signal is supplied to at least one of the scan electrode (Y) 202, the sustain electrode (Z) 203, and the address electrode (X) 213, the discharge is induced within the discharge cell partitioned by the barrier ribs 212.

Thus, the discharge gas filled in the discharge cell generates vacuum ultraviolet rays, and the vacuum ultraviolet rays are applied to the phosphor layer 214 provided in the discharge cell.

Thus, the phosphor layer 214 generates predetermined visible rays, and the generated visible rays are emitted outside through the front substrate 201 having the upper dielectric layer 204. Thus, a predetermined image is displayed on an external surface of the front substrate 201.

FIG. 2A shows only a case that the scan electrode (Y) 202 and the sustain electrode (Z) 203 are constituted of single layers, respectively. However, unlike this, it is also possible that at least one of the scan electrode (Y) 202 and the sustain electrode (Z) 203 can be constituted of a plural layer. This will be described with reference to FIG. 2B below.

Referring to FIG. 2B, the scan electrode (Y) 202 and the sustain electrode (Z) 203 can be constituted of two layers, respectively.

Particularly, in consideration of a light transmission factor and an electrical conductivity, the scan electrode (Y) 202 and the sustain electrode (Z) 203 can comprise bus electrodes 202*b* and 203*b* formed of opaque silver (Ag) material, and transparent electrodes 202*a* and 203*a* formed of transparent Indium-Tin-Oxide (ITO) material. The scan electrode (Y) 202 and the sustain electrode (Z) 203 emit light generated within the discharge cell outside, and guarantee a driving efficiency.

The reason why the scan electrode (Y) 202 and the sustain electrode (Z) 203 comprise the transparent electrodes 202*a* and 203*a* as above is to allow the visible rays generated within the discharge cell to be effectively emitted outside the plasma display panel 100.

The reason why the scan electrode (Y) 202 and the sustain electrode (Z) 203 comprise the bus electrodes 202*b* and 203*b* is to compensate for relatively low electrical conductivities of the transparent electrodes 202*a* and 203*a* that may cause a decrease of the driving efficiency because the driving efficiency can decrease due to the low electrical conductivities of the transparent electrodes 202*a* and 203*a* in case where the scan electrode (Y) 202 and the sustain electrode (Z) 203 comprise only the transparent electrodes 202*a* and 203*a*.

In case where the scan electrode (Y) 202 and the sustain electrode (Z) 203 comprise the bus electrodes 202*b* and 203*b* as above, it is desirable that black layers 120 and 121 are further provided between the transparent electrodes 202*a* and 203*a* and the bus electrodes 202*b* and 203*b* so as to prevent external light from being reflected due to the bus electrodes 202*b* and 203*b*.

FIGS. 2A and 2B illustrate and describe only one example of the plasma display panel of the present invention. The present invention is not limited to the plasma display panel 100 having constructions of FIGS. 1A and 1B.

For example, the plasma display panel 100 of FIG. 1 illustrates only a case where the upper dielectric layer 204 and the lower dielectric layer 215 are constituted of single layers, respectively. However, it is also possible that at least one of the upper dielectric layer 204 and the lower dielectric layer 215 is constituted of a plural layer.

A black layer (not shown) for absorbing the external light can be further provided on the barrier rib 212, so as to prevent the external light from being reflected due to the barrier rib 212.

As such, the plasma display panel 100 using the driving method of the plasma display panel 100 can be variously changed in construction.

In the above detailed description of FIGS. 2A and 2B, at least one of the scan electrode (Y) 202, the sustain electrode (Z) 203, the address electrode (X) 213, the dielectric layers 204 and 215, the barrier rib 212, the phosphor layer 214, and the protective layer 205 can have lead (Pb) contents of 1000 PPM (parts per million).

The lead (Pb) contents of a total composition of the plasma display panel 100 can be made 1000 PPM or less, thereby making total lead (Pb) contents 1000 PPM or less.

The reason why the total lead (Pb) contents are made 1000 PPM or less as above is that the plasma display panel 100 containing an excessive amount of lead (Pb) can have a bad influence upon a human body.

The driving signal supplied to the plasma display panel 100 will be described with reference to the accompanying drawings below.

Figure 3:
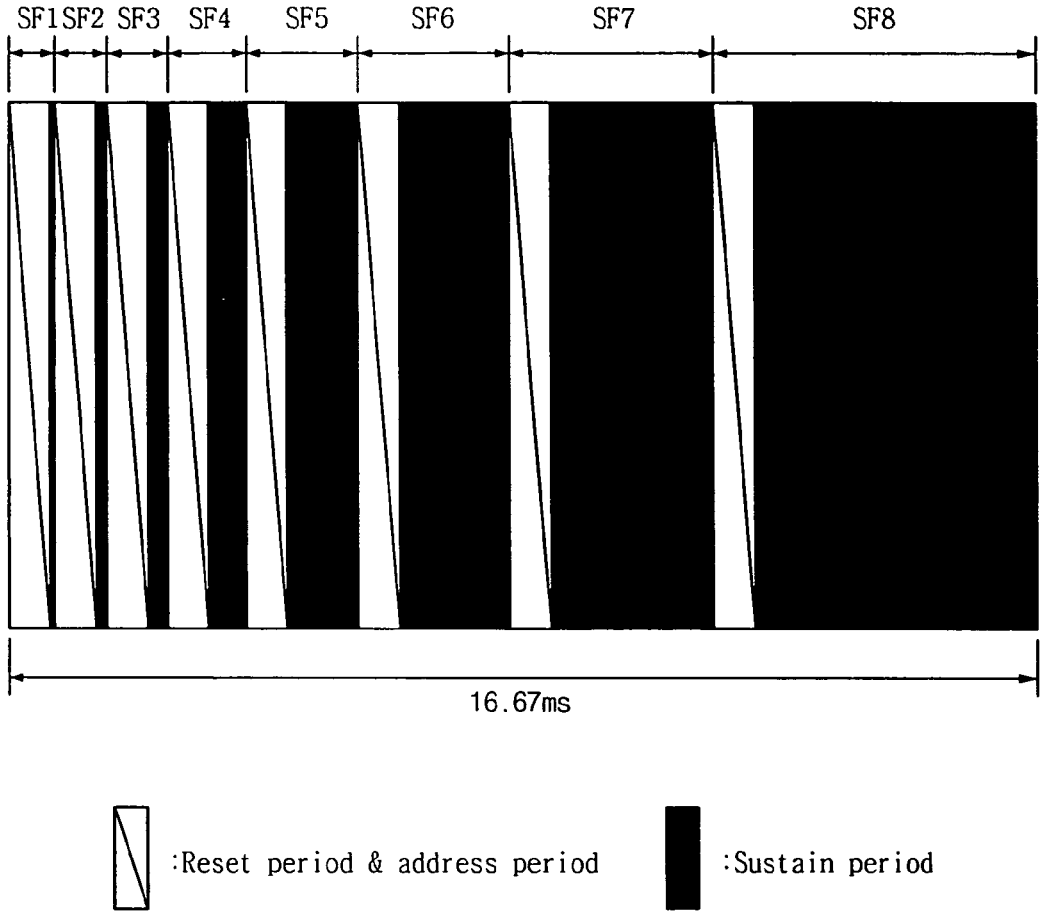
FIG. 3 illustrates a frame for embodying a gray level of an image on a plasma display panel.

FIG. 3 illustrates a frame for embodying a gray level of an image on the plasma display panel.

Figure 4:
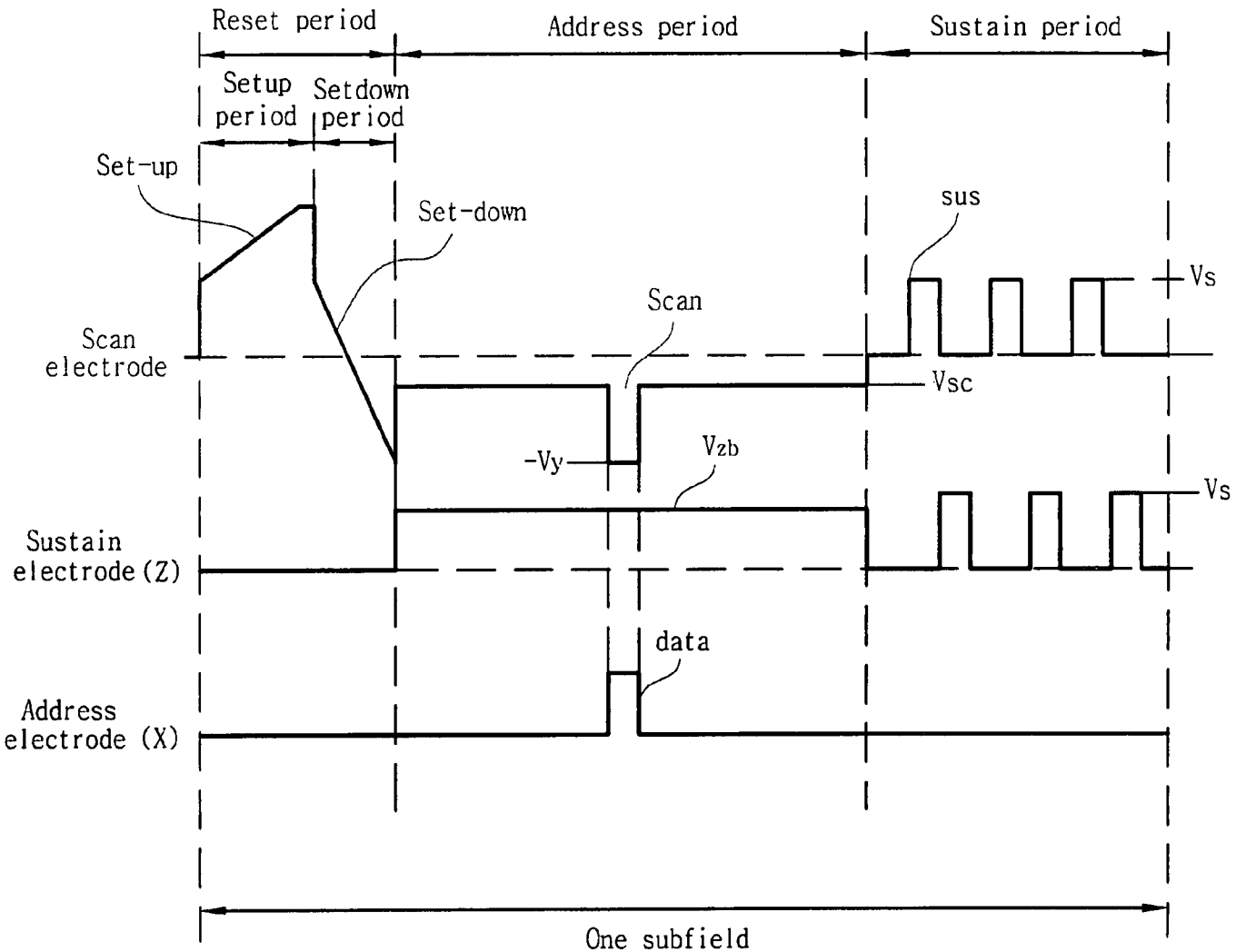
FIG. 4 illustrates an implementation of an operation of a plasma display panel.

FIG. 4 illustrates an implementation of an operation of the plasma display panel.

Referring to FIG. 3, the frame for embodying the gray level of the image on the plasma display panel 100 is divided into several subfields having the different number of times of light emission.

Though not illustrated, each of the subfields can be again divided into the reset period for initializing all the discharge cells, the address period for selecting the discharge cell to be discharged, and the sustain period for embodying the gray level depending on the number of times of discharge.

For example, when the image is expressed by 256 gray levels, a frame period (16.67 ms) corresponding to 1/60second is divided into eight subfields (SF1 to SF8), and each of the eight subfields (SF1 to SF8) is again divided into the reset period, the address period, and the sustain period.

The sustain signals supplied during the sustain period can be controlled in number, thereby setting a gray level weight of the corresponding subfield. In other words, each of the subfields can be allocated a predetermined gray level weight, using the sustain period.

For example, the gray level weight of each subfield can be determined so that the gray level weight of each subfield increase at a rate of $2^n$ (n=0, 1, 2, 3, 4, 5, 6, 7) in such a manner that a gray level weight of a first subfield is set to $2^0$ and a gray level weight of a second subfield is set to $2^1$.

As such, the number of the sustain signals supplied during the sustain period of each subfield is controlled depending on the gray level weight in each subfield, thereby embodying gray levels of various images.

In an implementation of the plasma display apparatus, a plurality of frames is used for displaying an image of one second. For example, sixty frames are used for displaying the image of one second.

FIG. 3 illustrates and describes only a case where one frame is constituted of eight subfields. Unlike this, the number of the subfields constituting one frame can be changed variously. For example, twelve subfields from a first subfield to a twelfth subfield can constitute one frame, or ten subfields can constitute one frame.

Unlike FIG. 3, the subfields can be arranged within one frame irrespective of a sequence of the gray level weights of the subfields.

A picture quality of the image embodied in the plasma display apparatus embodying the gray level of the image by the frame can be determined depending on the number of the subfields comprised in the frame.

In other words, when the number of the subfields comprised in the frame is twelve, $2^{12}$ image gray levels can be expressed, and when the number of the subfields comprised in the frame is eight, $2^8$ image gray levels can be expressed.

In FIG. 3, the subfields are arranged in a sequence of increasing a magnitude of the gray level weight in one frame. Unlike this, the subfields can be arranged in a sequence of decreasing the magnitude of the gray level weight in one frame, or can be arranged irrespective of the gray level weight.

FIG. 4 shows an implementation of an operation of the plasma display panel 100 in any one subfield among the plurality of subfields comprised in one frame like FIG. 3.

Referring to FIG. 4, the scan driver 102 can supply a setup signal, whose voltage gradually increases, to the scan electrode (Y) during a setup period of the reset period.

The setup signal induces a setup discharge, which is a weak dark discharge, within the discharge cell. By the setup discharge, wall charges of any extent are accumulated within the discharge cell.

In a setdown period after the setup period, a setdown signal whose voltage gradually decreases from a predetermined positive voltage lower than a peak voltage of the setup signal can be supplied after the setup signal is supplied to the scan electrode (Y).

Accordingly, a weak erase discharge, that is, a setdown discharge is induced within the discharge cell. This setdown discharge causes an erasure of some of the wall charges accumulated within the discharge cell by the earlier setup discharge, thereby allowing the wall charges of an extent stably inducing the address discharge to uniformly remain within the discharge cell.

As above, FIG. 4 illustrates an implementation of a case in which the reset signal comprises the setup signal and the setdown signal supplied during the setup period and the setdown period. However, it is also possible to comprise another period for supplying another signal before the reset period.

For example, a pre reset period during which the setdown signal whose voltage gradually falls is supplied to the scan electrode (Y) and a signal sustaining a predetermined positive voltage is supplied to the sustain electrode (Z) can be also comprised before the reset period.

During the address period after the reset period comprising the setup period and the setdown period, a scan reference voltage (Vsc) and a scan signal (Scan) falling from the scan reference voltage (Vsc) can be supplied to the scan electrode (Y).

The scan signal (Scan) can fall to a negative scan voltage (−Vy).

The scan signal is supplied to the scan electrode (Y) by the scan driver 102.

When the scan signal is supplied to the scan electrode (Y), the data signal can be correspondingly supplied to the address electrode (X).

The data signal is supplied to the address electrode (X) by the data driver 101 of FIG. 2.

A sustain bias signal (Vzb) can be supplied to the sustain electrode (Z) during the address period so as to prevent erroneous discharge from being induced due to an interference of the sustain electrode (Z) during the address period.

The sustain bias signal (Vzb) can be supplied to the sustain electrode (Z) by the sustain driver 103 of FIG. 2.

During the address period, a voltage difference between the scan signal and the data signal is added to a wall voltage caused by the wall charges generated during the reset period while the address discharge is induced within the discharge cell to which the data signal is supplied.

In the discharge cell selected by the address discharge, the wall charges of the extent inducing the discharge are formed when a sustain voltage (Vs) of the sustain signal is supplied.

During the sustain period after the address period, the sustain signal (SUS) can be supplied to the scan electrode (Y) or the sustain electrode (Z).

The sustain signal (SUS) is supplied to the scan electrode (Y) or the sustain electrode (Z) by the scan driver 102 denoted by a reference numeral 202 in FIG. 2 and/or the sustain driver 103 denoted by a reference numeral 203.

In the discharge cell selected by the address discharge, the wall voltage within the discharge cell is added to the sustain voltage (Vs) of the sustain signal (SUS), while the sustain signal (SUS) induces a display discharge, which is the sustain discharge, between the scan electrode (Y) and the sustain electrode (Z) when the sustain signal (SUS) is supplied. Thus, a predetermined image is embodied on the plasma display panel 100.

The above illustrates and describes only a case in which the sustain signal (SUS) is alternately supplied to the scan electrode (Y) and the sustain electrode (Z). Unlike this, it is also possible to supply the sustain signal (SUS) only to any one of the scan electrode (Y) and the sustain electrode (Z).

For example, the sustain signal can be supplied only to the scan electrode (Y) among the scan electrode (Y) and the sustain electrode (Z).

In detail, the sustain signal of a type rising from a ground level (GND) to a positive sustain voltage (+Vs) and again falling from the ground level (GND) to a negative sustain voltage (−Vs) can be supplied to any one of the scan electrode (Y) and the sustain electrode (Z), and a ground level (GND) voltage can be supplied to the other electrode.

The plasma display panel 100 operating as above has the total lead (Pb) contents of 1000 PPM or less and thus, has a greater possibility of an unstable discharge characteristic.

In a detailed description, a melting point of lead (Pb) is relatively low and its formation is easy. Thus, lead (Pb) is popularly used for a manufacture of the plasma display panel 100. A capacitance of lead (Pb), which is metal, is relatively low.

Thus, containing a relatively large amount of lead, the plasma display panel 100 is relatively lowered in total capacitance.

In the present invention, considering the bad influence upon the human body, lead (Pb) is limited to 1000 PPM or less in its amount comprised in the plasma display panel 100.

Thus, when the lead contents comprised in the plasma display panel 100 are made 1000 PPM or less, the capacitance relatively increases.

As such, when the capacitance increases, the discharge characteristic gets unstable. Due to the unstable discharge characteristic, the image embodied is also deteriorated in quality.

In order to prevent it, the scan driver 102 supplies the first driving signal to the scan electrode (Y) in the first subfield during the first reset period for initializing the discharge cell, the first address period for scanning the discharge cell, and the first sustain period for sustaining the discharge of the discharge cell, and supplies the second driving signal to the scan electrode (Y) in the second subfield during the second reset period having the different time duration from the first reset period, the second address period having the different time duration from the first address period, and the second sustain period having the different time duration from the first sustain period.

The first subfield and the second subfield are comprised in one frame. The first subfield is at least one of the plurality of subfields comprised in one frame, and the second subfield is at least one of the subfields other than the first subfield among the plurality of subfields comprised in one frame.

In other words, the reset period, the address period, and the sustain period are differently controlled in time duration depending on the subfield, thereby solving the unstable discharge characteristic caused by the increase of the capacitance. This will be in detail described below.

Figure 5A:
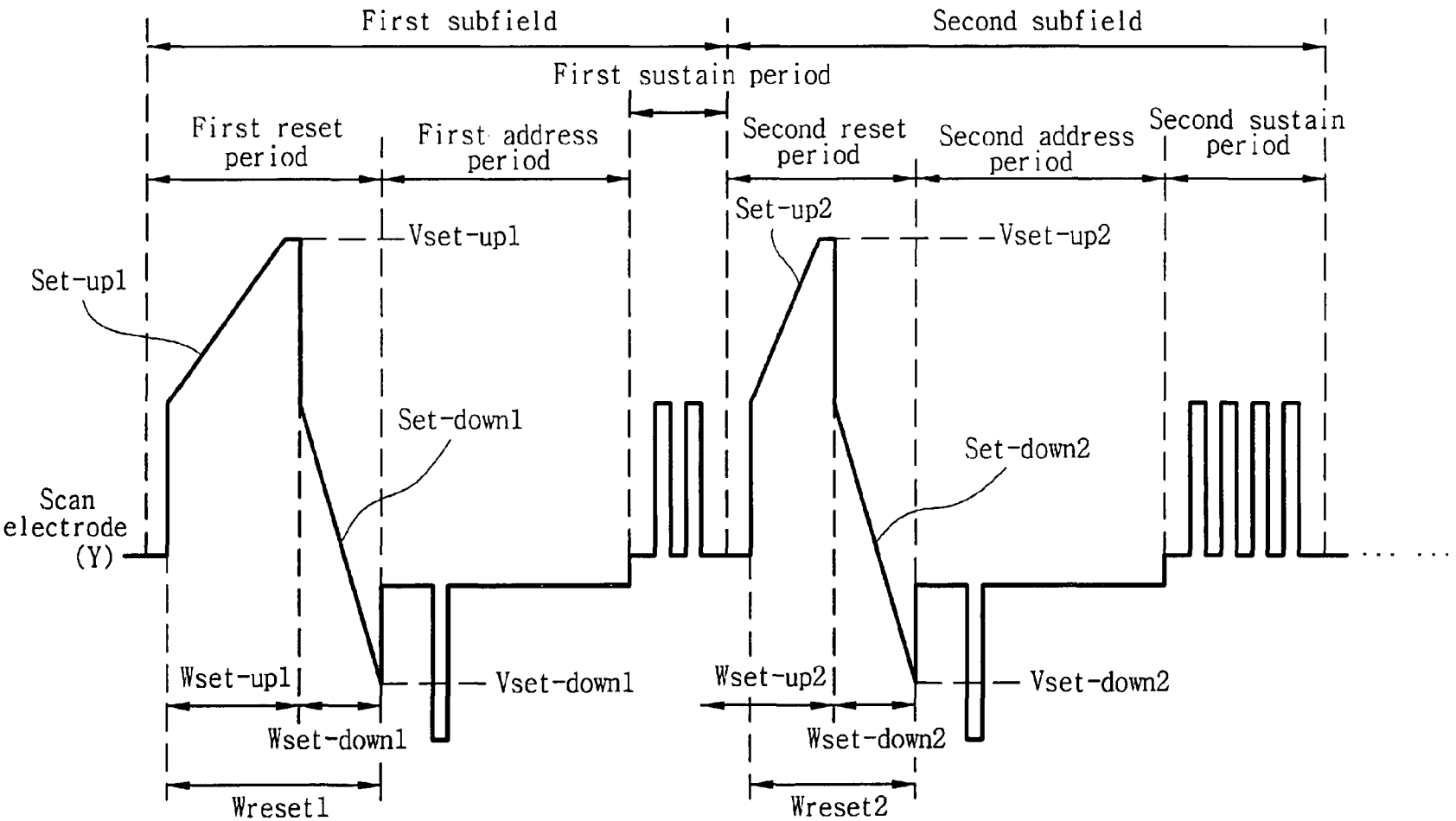
FIGS. 5A and 5B illustrate an implementation of a method for controlling a width of a reset signal and differently controlling a time duration of a reset period.
Figure 5B:
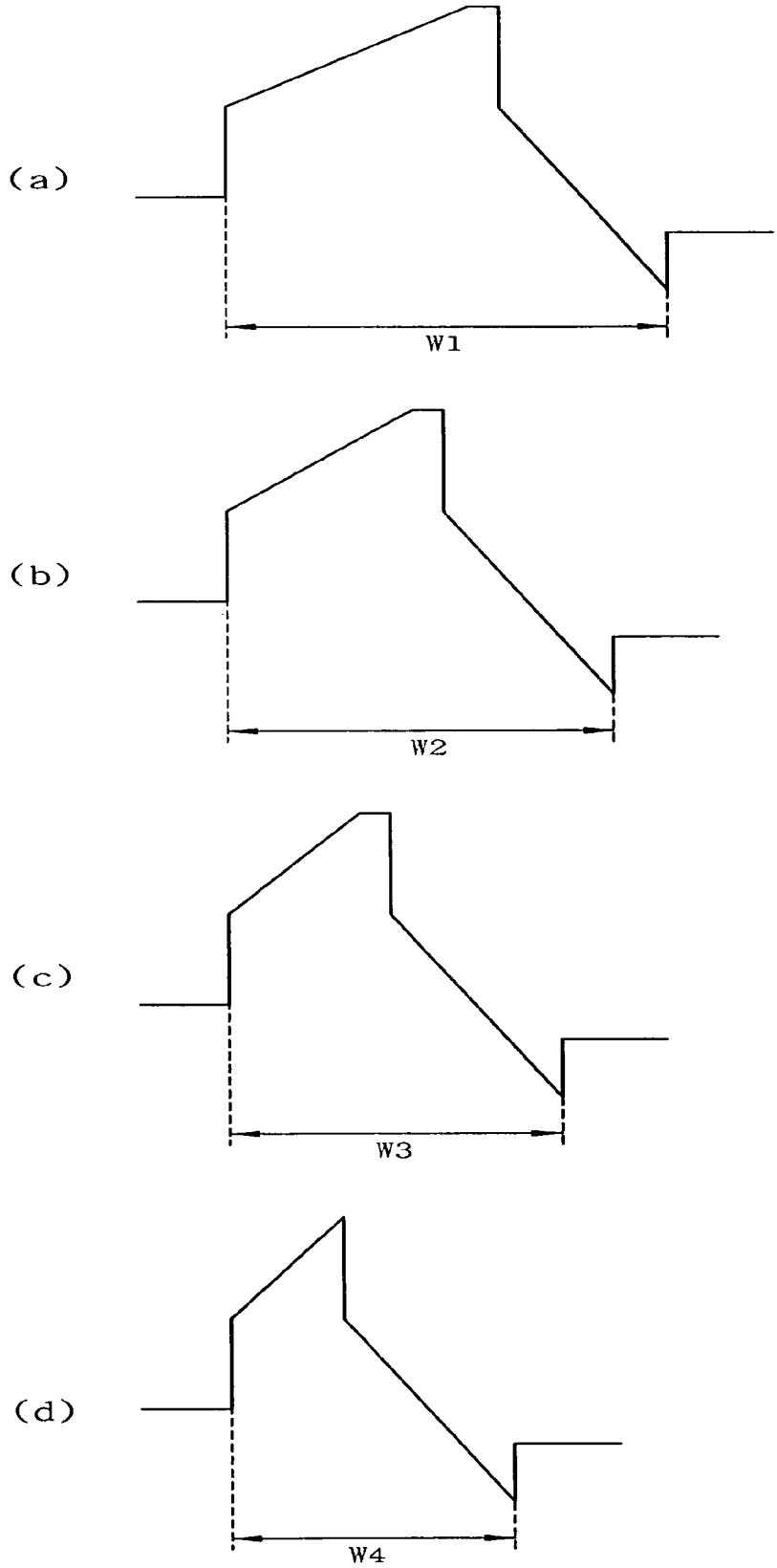

FIGS. 5A and 5B illustrate an implementation of a method for controlling a width of the reset signal and differently controlling the time duration of the reset period.

Referring to FIG. 5A, a width (Wreset1) of a first reset signal of the first driving signal supplied to the scan electrode (Y) during the first reset period can be differentiated from a width (Wreset2) of a second reset signal of the second driving signal supplied to the scan electrode (Y) during the second reset period.

As shown in FIG. 5A, in one example in which the width (Wreset1) of the first reset signal is different from the width (Wreset2) of the second reset signal, it is exemplified that, when the width (Wreset1) of the first reset signal is less than the width (Wreset2) of the second reset signal, a width (Wsetup1) of a first setup signal is less than a width (Wsetup2) of a second setup signal, and a width (Wsetdn1) of a first setdown signal is less than a width (Wsetdn2) of a second setdown signal.

However, unlike FIG. 5A, in another example in which the width (Wreset1) of the first reset signal is differentiated from the width (Wreset2) of the second reset signal, only the width (Wsetup2) of the second setup signal can be differentiated from the width (Wsetup1) of the first setup signal, or only the width (Wsetdn2) of the second setdown signal can be differentiated from the width (Wsetdn1) of the first setdown signal.

As shown in FIG. 5A, when the widths of the setup signals or the widths of the setdown signals are differentiated from each other as above, a slope can vary and thus, the widths can be also differentiated. Unlike this, maximum voltages of the setup signals can be differentiated from each other, or minimum voltages of the setdown signals can be differentiated from each other, thereby also differentiating the widths of the reset signals from each other.

As above, during the reset period, the width of the reset signal supplied to the scan electrode (Y) can be differently controlled, thereby differently controlling a total time duration of the reset period.

It is desirable that, when the width of the reset signal gets smaller in the second subfield than the first subfield as shown in FIG. 5A, a gray level weight of the first subfield relatively gets smaller than that of the second subfield.

The reason why the width of the reset signal supplied to the scan electrode (Y) during the reset period of the subfield having the relatively smaller gray level weight gets greater is that a possibility of unstable discharge relatively gets greater because the number of the sustain signals supplied during the sustain period relatively get smaller at the subfield having the relatively smaller gray level weight.

In other words, in the subfield having the relatively smaller gray level weight, in which the sustain signals are relatively small in number and thus, the possibility of unstable discharge is relatively great, the reset signal gets greater in width, thereby preventing a reset discharge from being unstabilized even when the total lead contents are set to be 1000 PPM or less.

As shown in FIG. 5A, in case where the setup signal and the setdown signal of the reset signal are all comprised, the first setup signal and the second setup signal can have maximum voltages ranging from 250V to 350V, and the first setdown signal and the second setdown signal can have minimum voltages ranging from −210V to −140V.

The maximum voltages of 250V or more of the first setup signal and the second setup signal are to allow a uniform and stable accumulation of the wall charges within the plurality of discharge cells comprised in a whole of the plasma display panel.

The maximum voltages of 350V or less of the first setup signal and the second setup signal are to allow a more uniform and stable accumulation of the wall charges within the plurality of discharge cells comprised in the whole of the plasma display panel, and are to prevent a driver device for supplying the driving voltage from being damaged when an excessive magnitude of voltage is supplied to the plasma display panel in the reset period.

The minimum voltages of −210V or more of the first setdown signal and the second setdown signal are to allow the wall charges uniformly accumulated within the plurality of discharge cells to uniformly remain to the extent that the address discharge can be stably induced, and are to prevent the driver device from being damaged due to an excessively great negative voltage.

The minimum voltages of −140V or less the first setdown signal and the second setdown signal are to allow the wall charges uniformly accumulated within the plurality of discharge cells to more properly and uniformly remain to the extent that the address discharge can be stably induced.

Referring next to FIG. 5B, the reset signal can have a width of "W1" in a first subfield (SF1) of (a) among the subfields of the frame, and the reset signal can have a width of "W2" less than "W1" in a second subfield (SF2) of (b), and the reset signal can have a width of "W3" less than "W2" in a third subfield (SF3) of (c), and the reset signal can have a width of "W4" less than "W3" in a fourth subfield (SF4) of (d).

As such, the width of the reset signal can be variously controlled depending on the gray level weight of the subfield and thus, as a result, the time duration of the reset period can be variously controlled.

Figure 6:
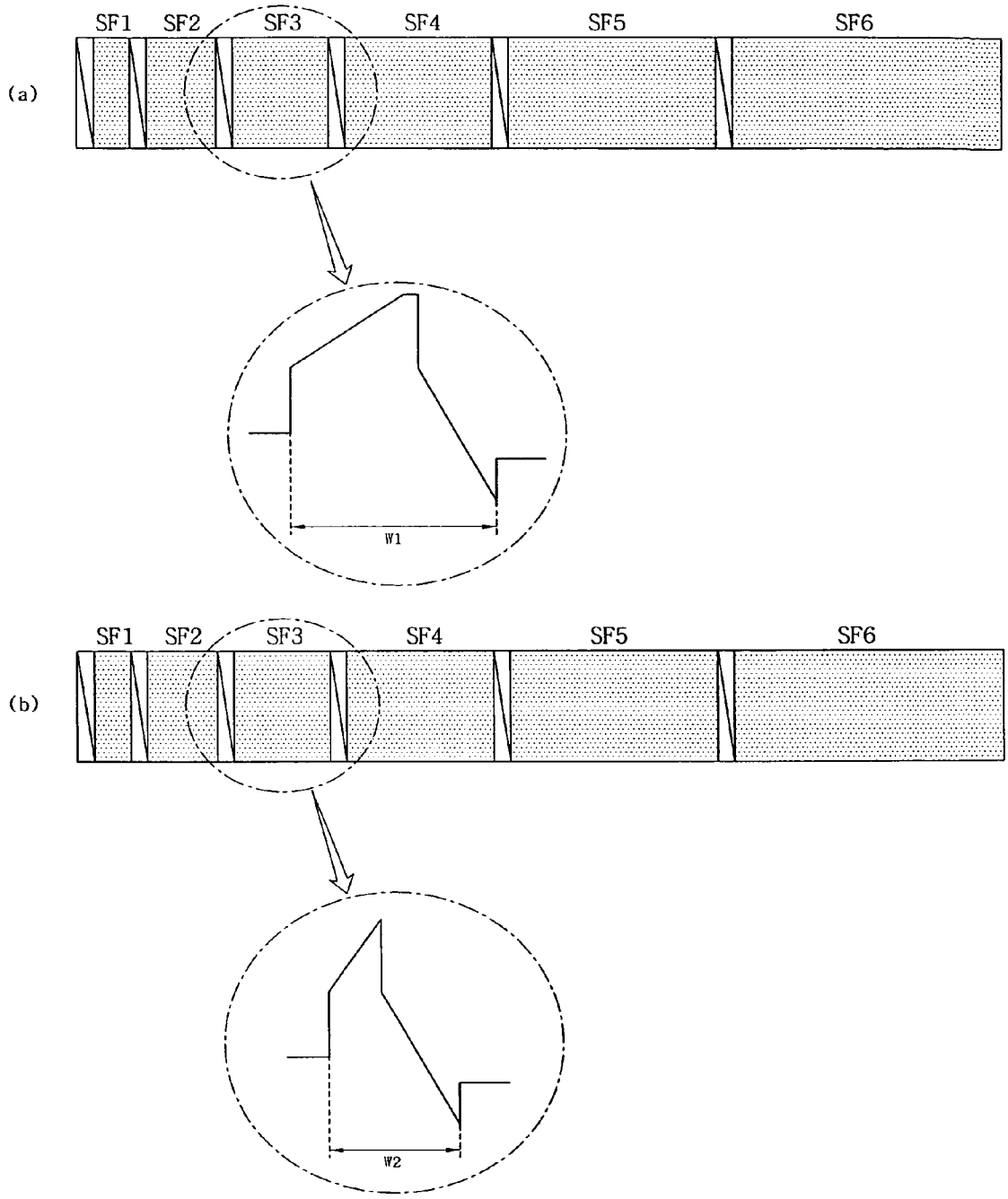
FIG. 6 illustrates another implementation of a method for controlling a width of a reset signal and differently controlling a time duration of a reset period.

FIG. 6 illustrates another implementation of a method for controlling the width of the reset signal.

As shown in FIG. 6, a first frame comprises a first subfield comprising a first reset signal, and a second frame comprises a second subfield comprising a second reset signal. A gray level weight of the first subfield and a gray level weight of the second subfield can be substantially equal to each other.

In FIG. 6, it is exemplified that the first frame and the second frame are a frame shown in (a) and a frame shown in (b), respectively, and the first subfield and the second subfield are a subfield (SF3) of the frame shown in the (a) and a subfield (SF3) of the frame shown in the (b), respectively.

In case where one frame is constituted of a total of six subfields, that is, 1st, 2nd, 3rd, 4th, 5th, and 6th subfields (SF1, SF2, SF3, SF4, SF5, and SF6) as shown in FIG. 6, the first reset signal can have a width of "W1" in the subfield (SF3) in the first frame of the (a), whereas the reset signal can be set to a width of "W2" less than that of the (a), in the subfield (SF3) in the second frame of the (b).

FIG. 6 illustrates that the width of the reset signal is differently controlled only in the subfield (SF3) among the subfields of the frame. Unlike this, it is also possible to differently control the width of the reset signal in predetermined one or more subfields among the subfields of the frame.

The width of the reset signal is relatively greatly controlled as in the (a) when the plasma display panel 100 relatively greatly increases in temperature.

For example, when the plasma display panel 100 is relatively high in temperature, kinetic energies of space charges distributed within the discharge cell increases and the space charges more actively move within the discharge cell, thereby increasing a rate of bonding and electrically neutralizing the space charges with the wall charges within the discharge cell. Thus, a discharge firing voltage can increase, thereby reducing a driving efficiency.

In particular, in case where the lead contents of the plasma display panel 100 are controlled by 1000 PPM or less and a total capacitance increases, when the plasma display panel 100 relatively greatly increases in temperature, the driving efficiency can be more reduced. In order to prevent it, when the plasma display panel 100 is in a relatively high temperature, the width of the reset signal is relatively greatly controlled.

The method for differently controlling the width of the reset signal is described above. Unlike this, it is also possible to control the number of the reset signals. This will be described below.

Figure 7A:
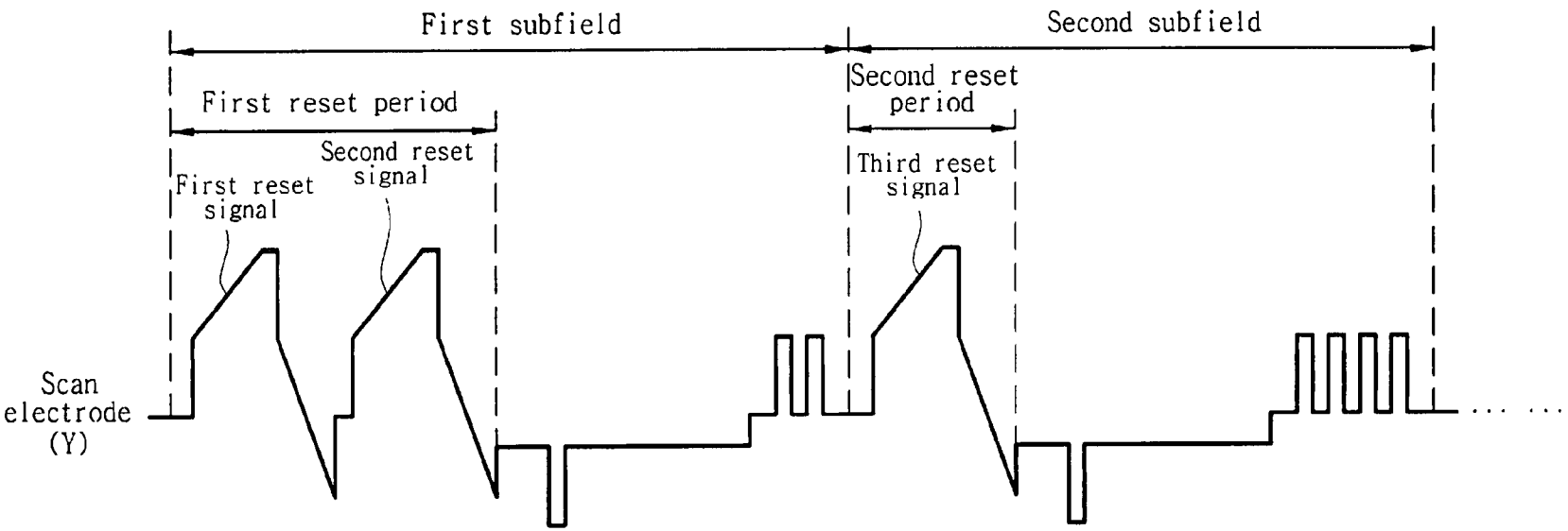
FIGS. 7A and 7B illustrate an implementation of a method for controlling the number of reset signals and differently controlling a time duration of a reset period.
Figure 7B:
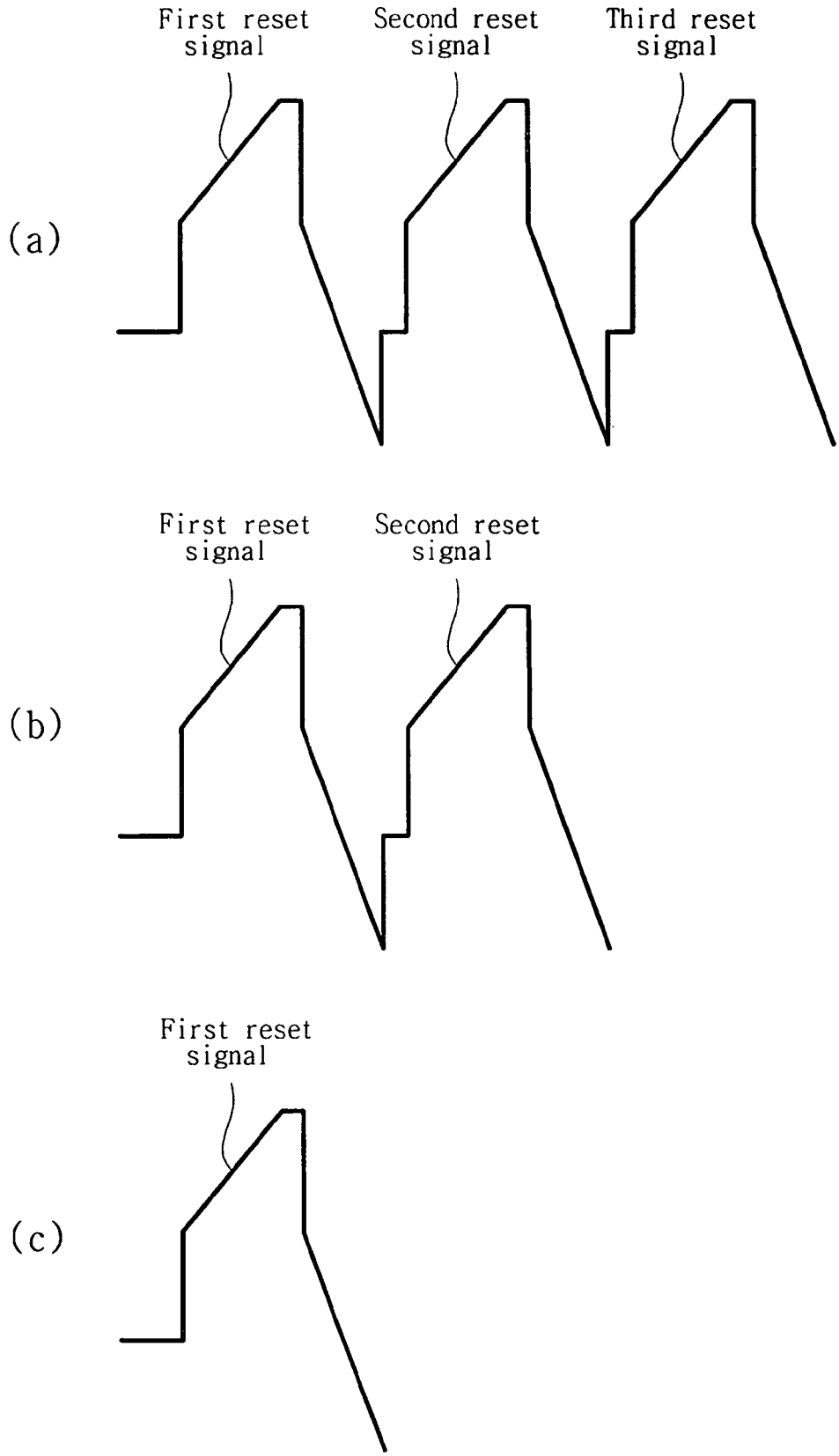

FIGS. 7A and 7B illustrate an implementation of a method for controlling the number of the reset signals and differently controlling the time duration of the reset period.

As shown in FIG. 7A, the number of first reset signals supplied to the scan electrode (Y) during the first reset period of the first subfield can be differentiated from the number of second reset signals supplied to the scan electrode (Y) during the second reset period of the second subfield.

In a more detailed description, the number of the first reset signals supplied to the scan electrode (Y) in the first subfield is two, and the number of the second reset signals supplied to the scan electrode (Y) in the second subfield is one. As such, the number of the reset signals supplied to the scan electrode (Y) during the reset period can be controlled, thereby differently controlling the total time duration of the reset period.

It is desirable that a gray level weight of the first subfield is relatively less than that of the second subfield.

During the reset period of a subfield having a relatively lower gray level weight, the number of the reset signals supplied to the scan electrode (Y) is higher so that, in the subfield having the relatively lower gray level weight, the number of the sustain signals supplied in the sustain period is relatively lower and thus, the possibility of the unstable discharge is relatively higher.

In other words, in the subfield having the relatively smaller gray level weight in which the number of the sustain signals is relatively less and thus, the possibility of the unstable discharge is relatively great, the number of the reset signals can be more, thereby preventing the reset discharge from being unstabilized even when the total lead contents are set to be 1000 PPM or less.

Referring next to FIG. 7B, the number of the reset signals is three in the first subfield of (a) among the subfields of the frame, and the number of the reset signals is two less than that of the first subfield, in the second subfield of (b), and the number of the reset signals is one less than that of the second subfield, in the third subfield of (c).

As such, the number of the reset signals can be variously controlled depending on the gray level weight of the subfield and thus, as a result, the time duration of the reset signal can be variously controlled.

Figure 8:
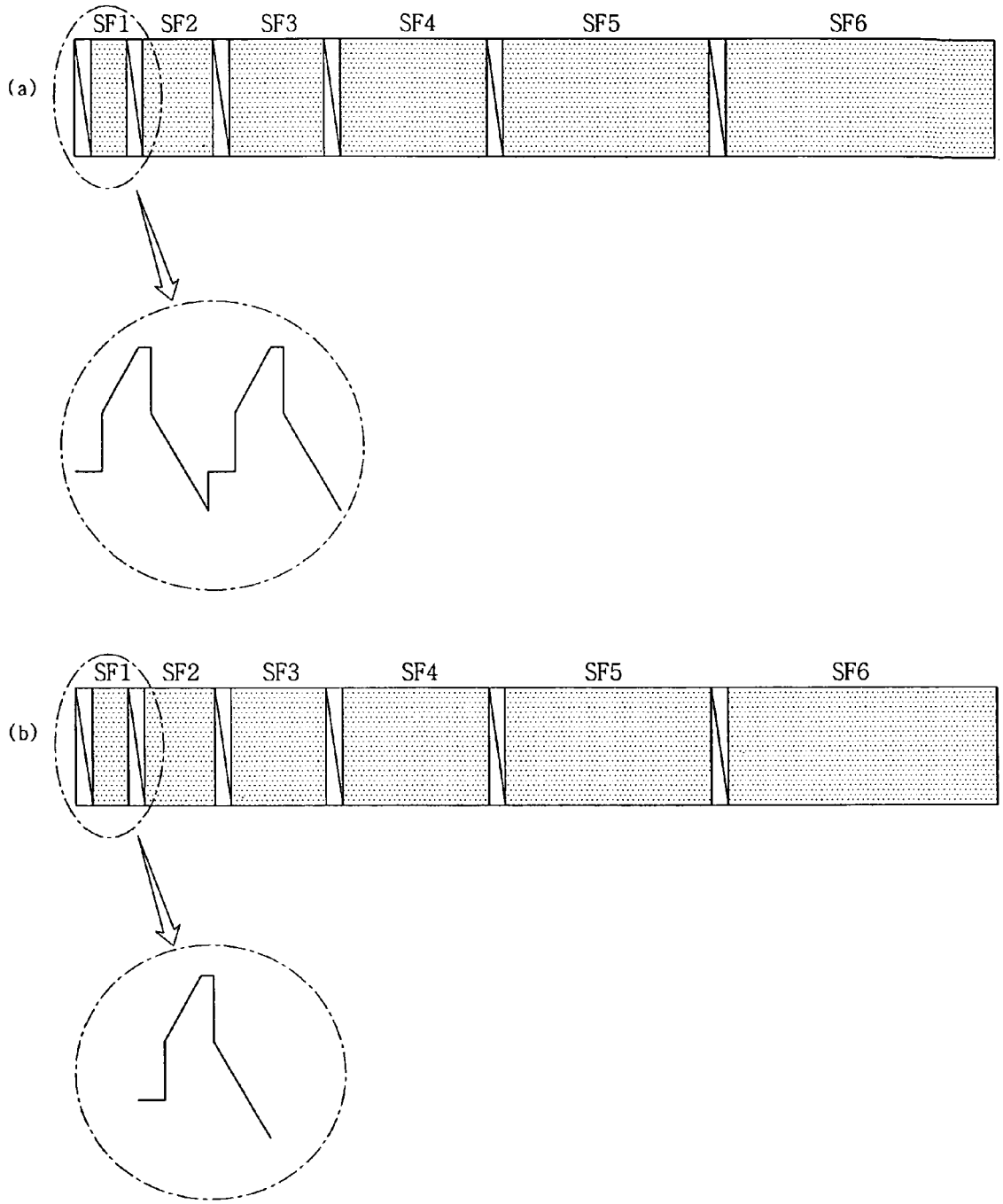
FIG. 8 illustrates another implementation of a method for controlling the number of reset signals and differently controlling a time duration of a reset period.

FIG. 8 illustrates another implementation of a method for controlling the number of the reset signals and differently controlling the time duration of the reset period.

As shown in FIG. 8, a first frame comprises a first subfield, and a second frame comprises a second subfield. In case where a gray level weight of the first subfield is substantially equal to a gray level weight of the second subfield, the number of first reset signals comprised in the first subfield can be differentiated from the number of second reset signals comprised in the second subfield, thereby differentiating the width of the first reset signal from the width of the second reset signal.

In FIG. 8, it is exemplified that the first subfield of the first frame is a first subfield (SF1) of (a), and the second subfield of the second frame is a first subfield (SF1) of (b).

As shown in FIG. 8, in case where one frame is constituted of a total of six subfields, that is, 1st, 2nd, 3rd, 4th, 5th, 6th subfields (SF1, SF2, SF3, SF4, SF5, SF6), the number of the reset signals is two at the SF1 of (a) in the first frame, whereas the number of the reset signals can be set to one less than that of the (a), at the SF1 of (b) having the substantially same gray level weight as the first subfield of the (a).

FIG. 8 illustrates that the number of the reset signals is differently controlled only at the first subfield among the subfields of the frame. Unlike this, it is also possible to differently control the number of the reset signals in predetermined one or more subfields among the subfields of the frame.

The number of the reset signals is relatively greatly controlled as in the (a) when the plasma display panel 100 relatively greatly increases in temperature.

In other words, when the plasma display panel 100 is relatively high in temperature, the number of the reset signals is relatively more, thereby stabilizing the discharge.

The above illustrates and describes only a case that the reset signal is supplied to the scan electrode (Y) during the reset periods of all the subfields. Unlike this, it is also possible to supply the reset signal only in a predetermined subfield among the plurality of subfields of the frame. This will be described with reference to accompanying FIGS. 9A to 9D below.

FIGS. 9A to 9D illustrate another method for supplying the reset signal.

As shown in FIGS. 9A to 9D, the second reset signal supplied to the scan electrode (Y) during the second reset period of the second subfield can comprise one of the setup signal and the setdown signal. Alternately, the second reset signal can be a bias signal sustained at a first voltage.

Figure 9A:
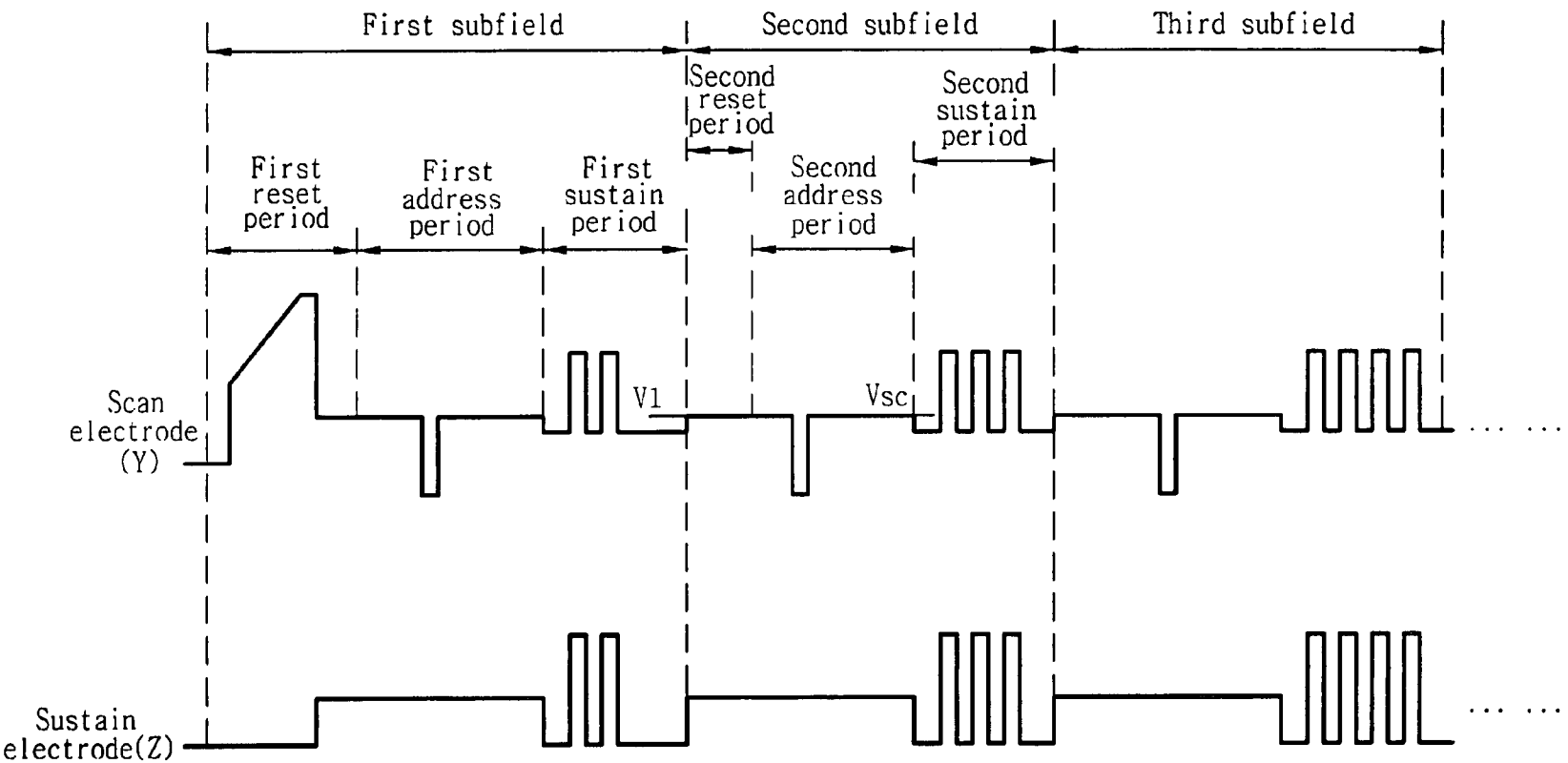
FIGS. 9A to 9D illustrate another method for supplying a reset signal.

For one example, referring to FIG. 9A, the first reset signal comprising the first setup signal is supplied to the scan electrode (Y) during the first reset period of the first subfield among the plurality of subfields of the frame, and the bias signal of the second reset signal sustained at the first voltage is supplied to the scan electrode (Y) during the second reset period of the second subfield.

The first voltage (V1) can be substantially equal to a scan reference voltage (Vsc) supplied to the scan electrode (Y) during the second address period of the second subfield.

It is desirable that the first subfield at which the first reset signal is supplied is a subfield having the least gray level weight among the plurality of subfields of the frame.

In FIG. 9A, for one example, it is illustrated that the reset signal is supplied only at the first subfield. Unlike this, it is also possible to supply the reset signal in the first subfield and the second subfield, respectively, and supply the second reset signal as a bias signal sustained at the first voltage in the subfields other than the first subfield and the second subfield.

Figure 9B:
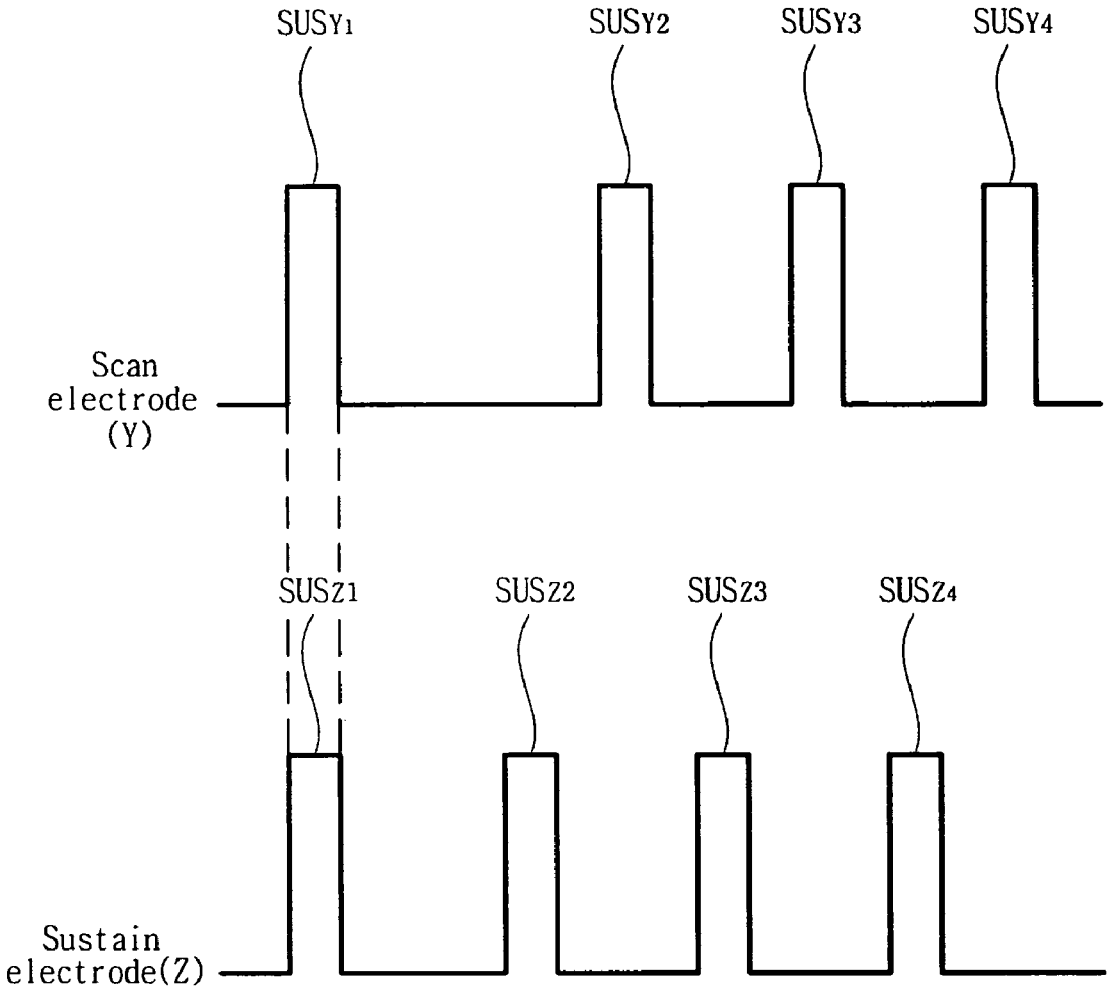

In case where the reset signal is supplied only in a specific subfield among the plurality of subfields of the frame, and the reset signal is supplied as the bias signal in the other subfields, the sustain signal can be set in a type of FIG. 9B that illustrates a detail of the second sustain period of the second subfield of FIG. 9A.

As shown in FIG. 9B, a plurality of sustain signals (SUSY1 to SUSY4, and SUSZ1 to SUSZ4) can be supplied to the scan electrode (Y) and the sustain electrode (Z) during the second sustain period of the second subfield. The first sustain signal (SUSY1) among the plurality of second sustain signals (SUSY1 to SUSY4) supplied to the scan electrode (Y) can mostly overlap with the first sustain signal (SUSZ1) among the plurality of sustain signals (SUSZ1 to SUSZ4) supplied to the sustain electrode (Z).

Thus, when the first sustain signals (SUSY1 and SUSZ1) are supplied, the sustain discharge is not induced, or though being induced, the sustain discharge is relatively weak in intensity.

The reason why the first sustain signals (SUSY1 and SUSZ1) overlap with each other as above is that the possibility of the unstable sustain discharge is great because the reset signal is supplied only in at least one subfield among the plurality of subfields of the frame and the reset signal is not supplied in other subfields.

In a detailed description, in case where the reset signal is not supplied and thus, a distribution of the wall charges is unstabilized within the discharge cell, if the sustain signal having a relatively high voltage is straightly supplied, the sustain discharge is excessively strongly induced and thus, the distribution of the wall charges is more unstabilized or the sustain discharge is too weakly induced within the discharge cell, thereby weakening even a sustain discharge induced by a subsequent sustain signal together.

If the first sustain signals (SUSY1 and SUSZ1) overlap with each other, the distribution of the wall charges can be stabilized within the discharge cell, thereby preventing the sustain discharge from being excessively strong induced or preventing an intensity of the sustain discharge induced by the subsequent sustain signal from being too weakened.

First, the second sustain signal is supplied to the sustain electrode (Z). In other words, after the first sustain signals (SUSY1 and SUSZ1) are supplied, the second sustain signal (SUSZ2) is supplied to the sustain electrode (Z) and then, the second sustain signal (SUSY2) is supplied to the scan electrode (Y).

If the second sustain signal (SUSZ2) is supplied to the sustain electrode (Z) faster than the scan electrode (Y), the last sustain signal (SUSY4 of FIG. 9B) can be supplied to the scan electrode (Y).

Thus, various changes are possible that another signal can be supplied to the scan electrode (Y) between a sustain period of one subfield and an address period of a next subfield.

Figure 9C:
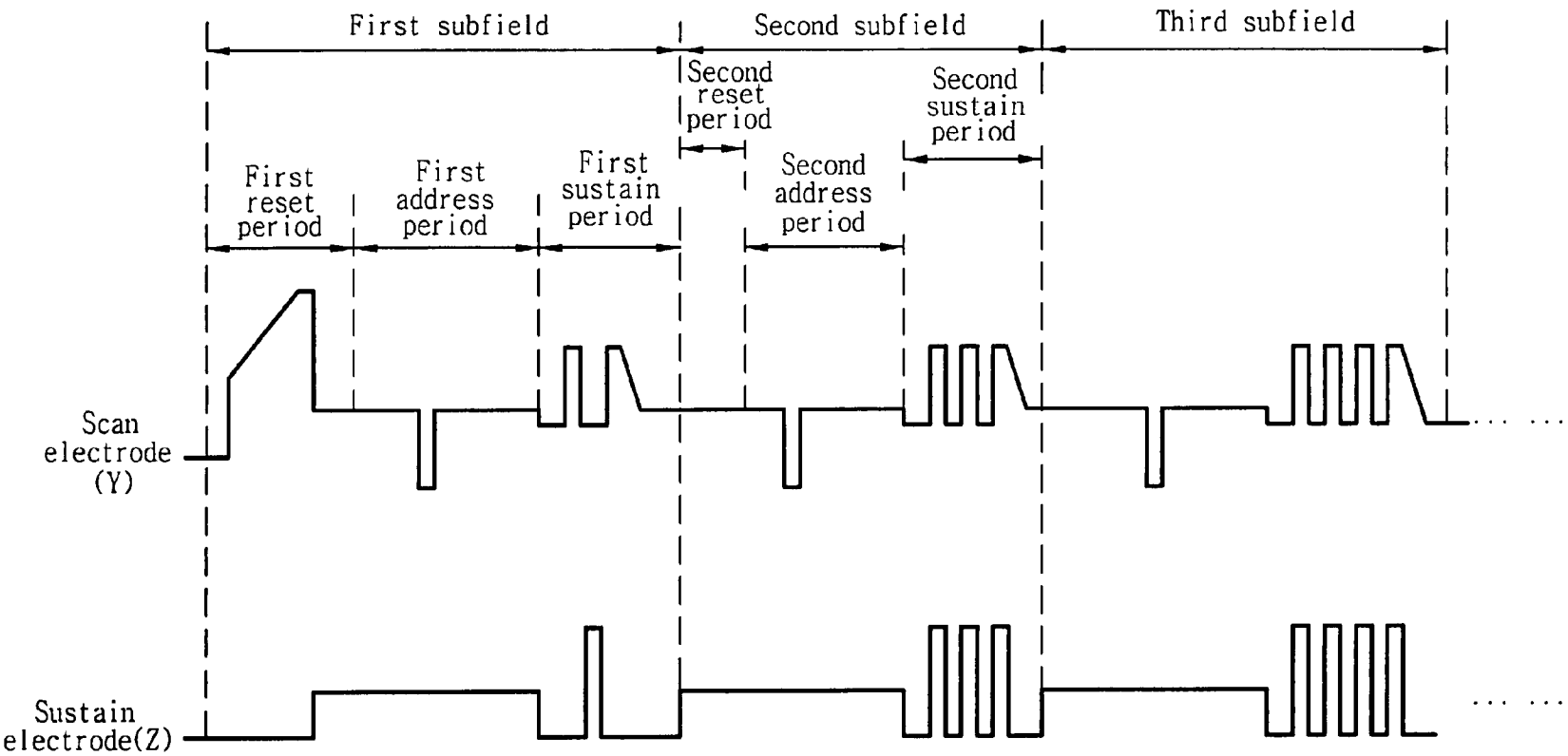

Referring next to FIG. 9C, unlike FIG. 9A, a first driving signal is supplied in a first subfield (SF1), and a second driving signal is supplied in a second subfield (SF2). In case where a second reset signal, which is a bias signal sustained at a first voltage being substantially equal to a scan reference voltage, is supplied during the second reset period of the second subfield, a falling slope of the last sustain signal among the plurality of sustain signals supplied to the scan electrode (Y) in the first subfield (SF1) that is a subfield earlier than the second subfield (SF2) can be substantially equal to a falling slope of a setdown signal supplied to the scan electrode (Y) during the setdown period.

The reason why the falling slope of the last sustain signal among the plurality of sustain signals supplied to the scan electrode (Y) in the subfield (SF1) earlier than the second subfield (SF2) is substantially equal to the falling slope of the setdown signal is to induce a more stable address discharge during the second address period of the second subfield (SF2) by appropriately erasing some of wall charges using the last sustain signal among a plurality of sustain signals supplied in the subfield (SF1) earlier than the second subfield (SF2), because a signal for appropriately erasing some of the wall charges within the discharge cell is not substantially supplied during the second reset period of the second subfield (SF2).

A case of FIG. 9C can be changed like FIG. 9B. This is in detail described enough as above and thus, a more description will be omitted.

Figure 9D:
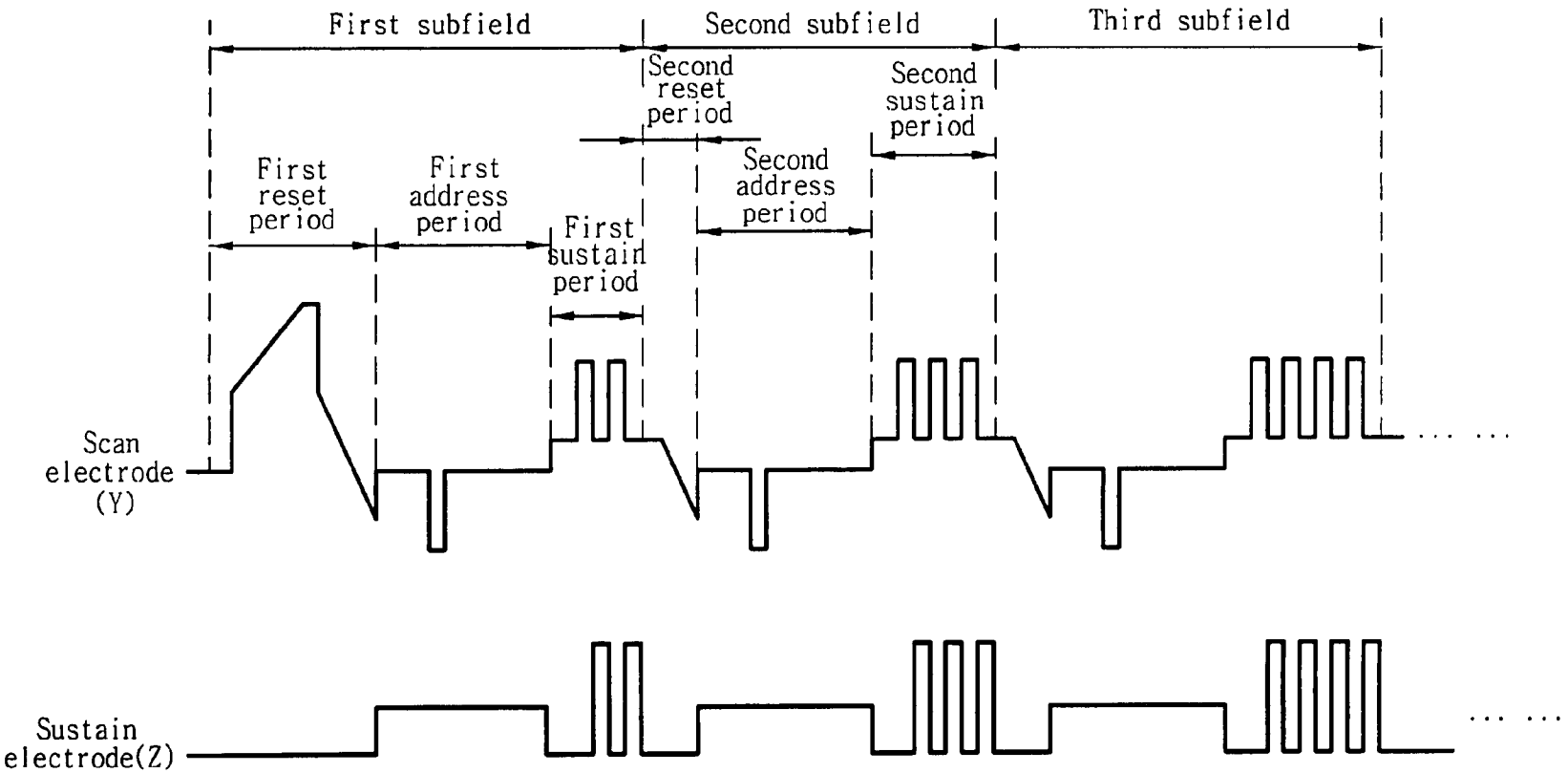

Referring next to FIG. 9D, a first reset signal constituted of a setup signal and a setdown signal is supplied during the first reset period of the first subfield, and a second reset signal comprising a setdown signal is supplied during the second reset period of the second subfield.

In the subfield at which the reset signal comprising the setup signal is not supplied, only the setdown signal can be supplied and the distribution of the wall charges can be more stabilized within the discharge cell.

The second reset signal supplied to the scan electrode (Y) during the second reset period of the second subfield can comprise only one of the setup signal and the setdown signal.

A case of FIG. 9D can be changed like FIG. 9B. This is in detail described enough as above and thus, a more description will be omitted.

Even a reset signal of a type different from the above described reset signal is applicable to the present invention. This will be described with reference to accompanying FIG. 10 below.

Figure 10:
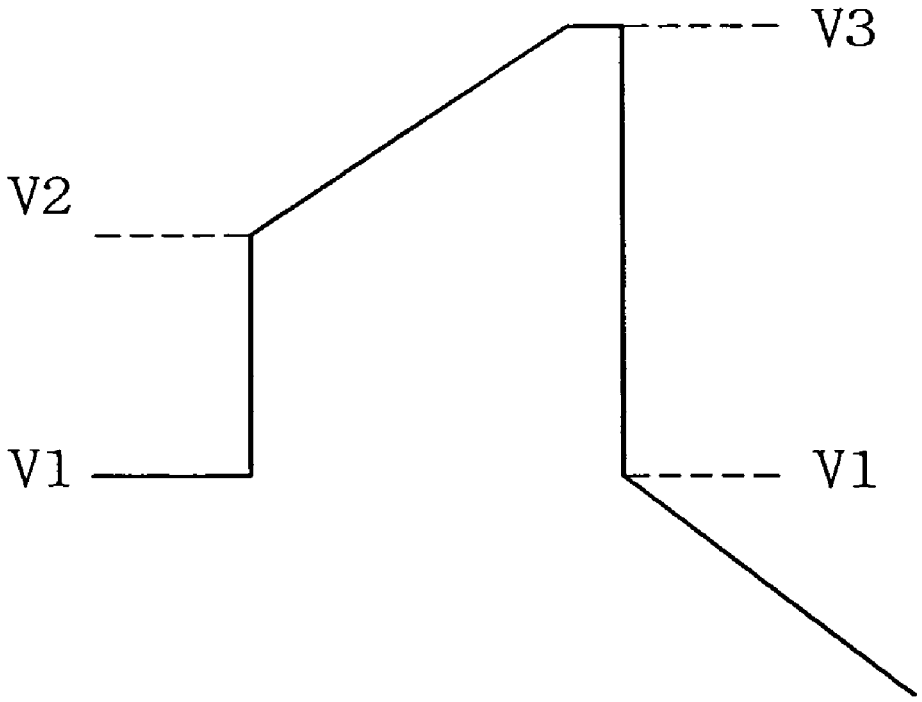
FIG. 10 illustrates various types of reset signals.
Figure 10:
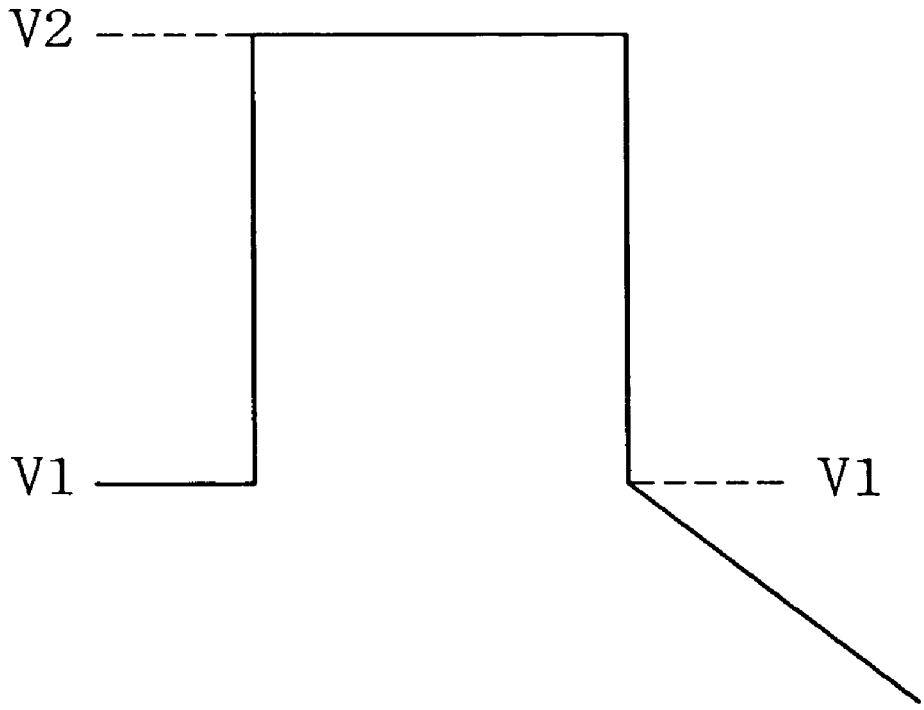

FIG. 10 illustrates various types of the reset signals.

Referring to FIG. 10, even a reset signal of a type of (a) in which a voltage suddenly rises from a first voltage (V1) to a second voltage (V2), again gradually rises from the second voltage (V2) to a third voltage (V3), again suddenly falls from the third voltage (V3) to the first voltage (V1), and again gradually falls from the first voltage (V1) is applicable to the present invention.

Together, it is also possible that the voltage of the (a), not suddenly, gradually rises from the first voltage (V1) to the second voltage (V2).

Even a reset signal of a type of (b) in which a voltage suddenly rises from a first voltage (V1) to a second voltage (V2), is sustained at the second voltage (V2) for a predetermined time, again falls to the first voltage (V1), and gradually falls from the first voltage (V1) is applicable to the present invention. In other words, even the reset signal of a type of a square wave is applicable.

The above illustrates and describes only a case that the reset period is differently controlled in time duration. A case that the address period is differently controlled in time duration will be described below.

Figure 11A:
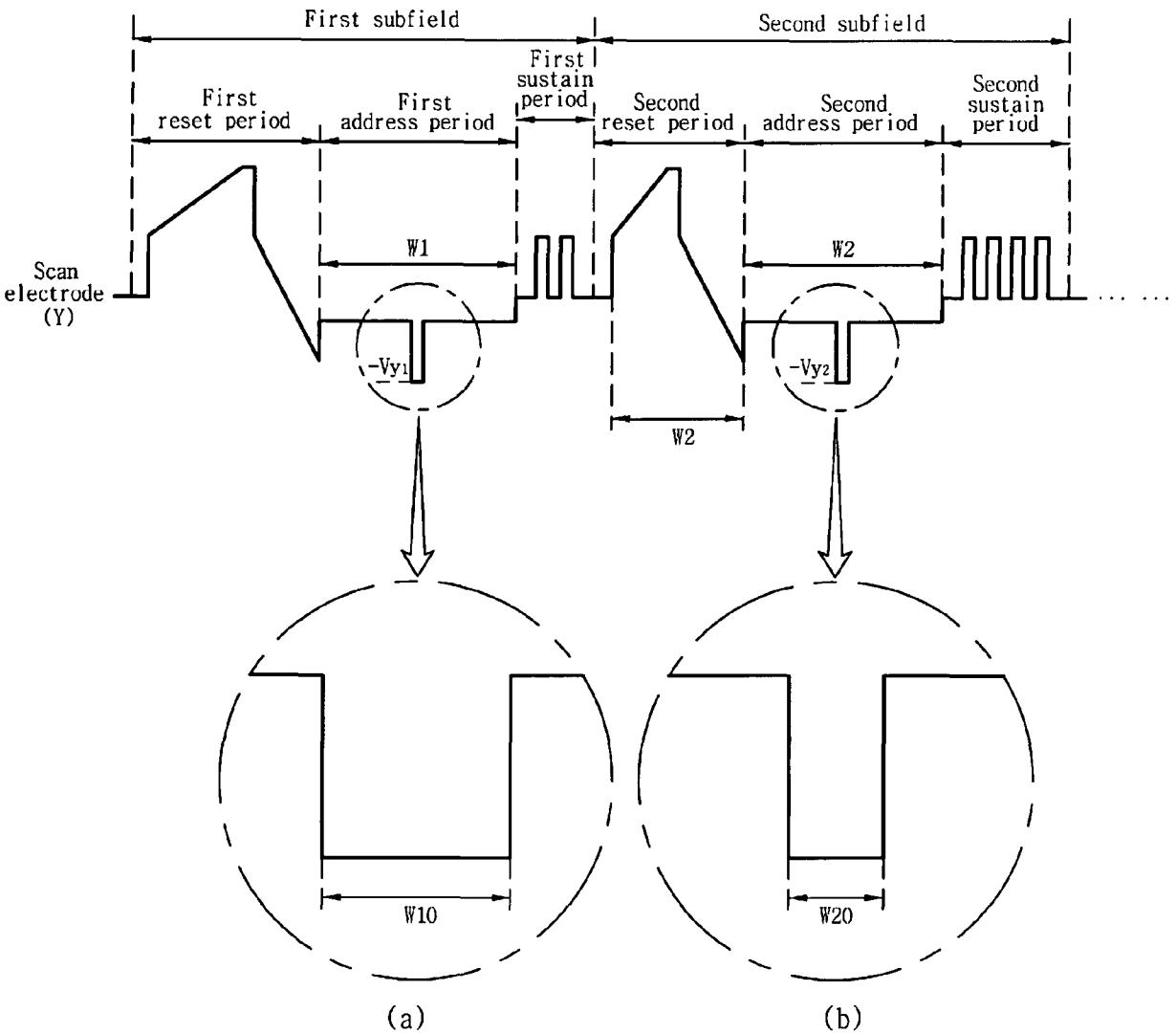
FIGS. 11A and 11B illustrate an implementation of a method for controlling a time duration of an address period.
Figure 11B:
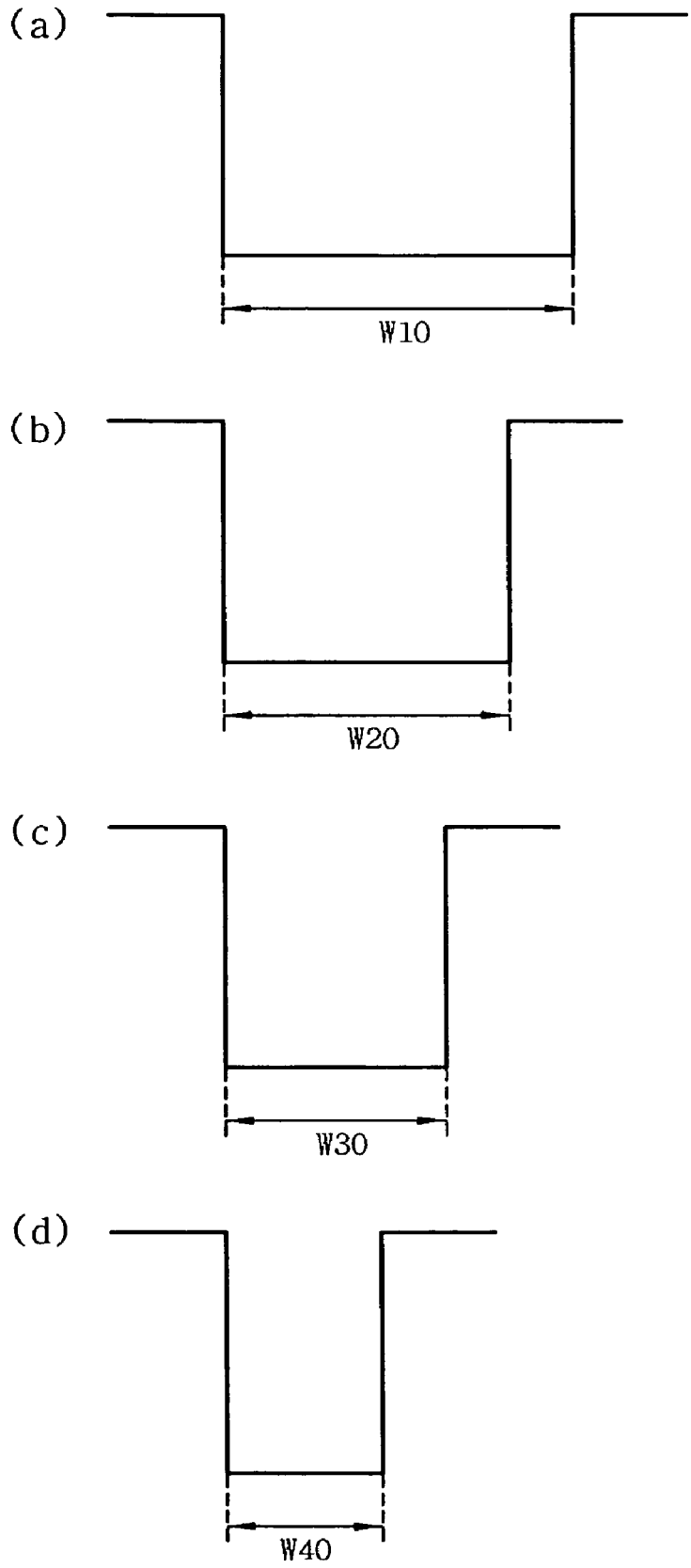

FIGS. 11A and 11B illustrate an implementation of a method for controlling a time duration of the address period.

Referring first to FIG. 11A, a width (W10) of a first scan signal supplied to the scan electrode (Y) during the first address period of the first subfield is different from a width (W20) of a second scan signal supplied to the scan electrode (Y) during the second address period of the second subfield.

The width of the scan signal supplied to the scan electrode (Y) during the address period can be controlled to the W10 or W20 as above, thereby controlling the time duration of the first address period of the first subfield by the W1, and controlling the time duration of the second address period of the second subfield by the W2 different from the W1.

The first scan signal and the second scan signal can have minimum voltages (−Vy) ranging from −250V to −150V.

The reason why the first scan signal and the second scan signal have the minimum voltages (−Vy) of −250V or more is to prevent a switching device of a circuit from being damaged by an excessively great voltage magnitude of the scan signal, and is to more stably scan the discharge cell to be turned on by the scan signal during the address period.

The reason why the first scan signal and the second scan signal have the minimum voltages (−Vy) of −150V or less is to stably scan the discharge cell to be turned on by the scan signal during the address period.

It is desirable that the first subfield has a relatively smaller gray level weight than the second subfield.

The reason why the width of the scan signal supplied to the scan electrode during the address period of the subfield having the relatively smaller gray level weight is that, in the subfield having the relatively small gray level weight, the number of the sustain signals supplied during the sustain period is relatively small and thus, the possibility of the unstable discharge is relatively greater.

In other words, in the subfield having the relatively small gray level weight, in which the number of the sustain signals is relatively less and thus, the possibility of the unstable discharge is relatively great, the width of the scan signal can be more increased, thereby preventing the address discharge from being unstabilized even when the total lead contents are set to 1000 PPM or less.

Referring next to FIG. 11B, a width of the scan signal can be set to W10 in a first subfield (SF1) of (a) among the subfields of the frame, and the width of the scan signal can be set to W20 smaller than that of the first subfield in a second subfield of (b), and the width of the scan signal can be set to W30 smaller than that of the second subfield in a third subfield (SF3) of (c), and the width of the scan signal can be set to W40 smaller than that of the third subfield, in a fourth subfield (SF4) of (d).

As such, the width of the scan signal can be variously controlled depending on the gray level weight of the subfield, thereby resultantly variously controlling the time duration of the address period.

Figure 12:
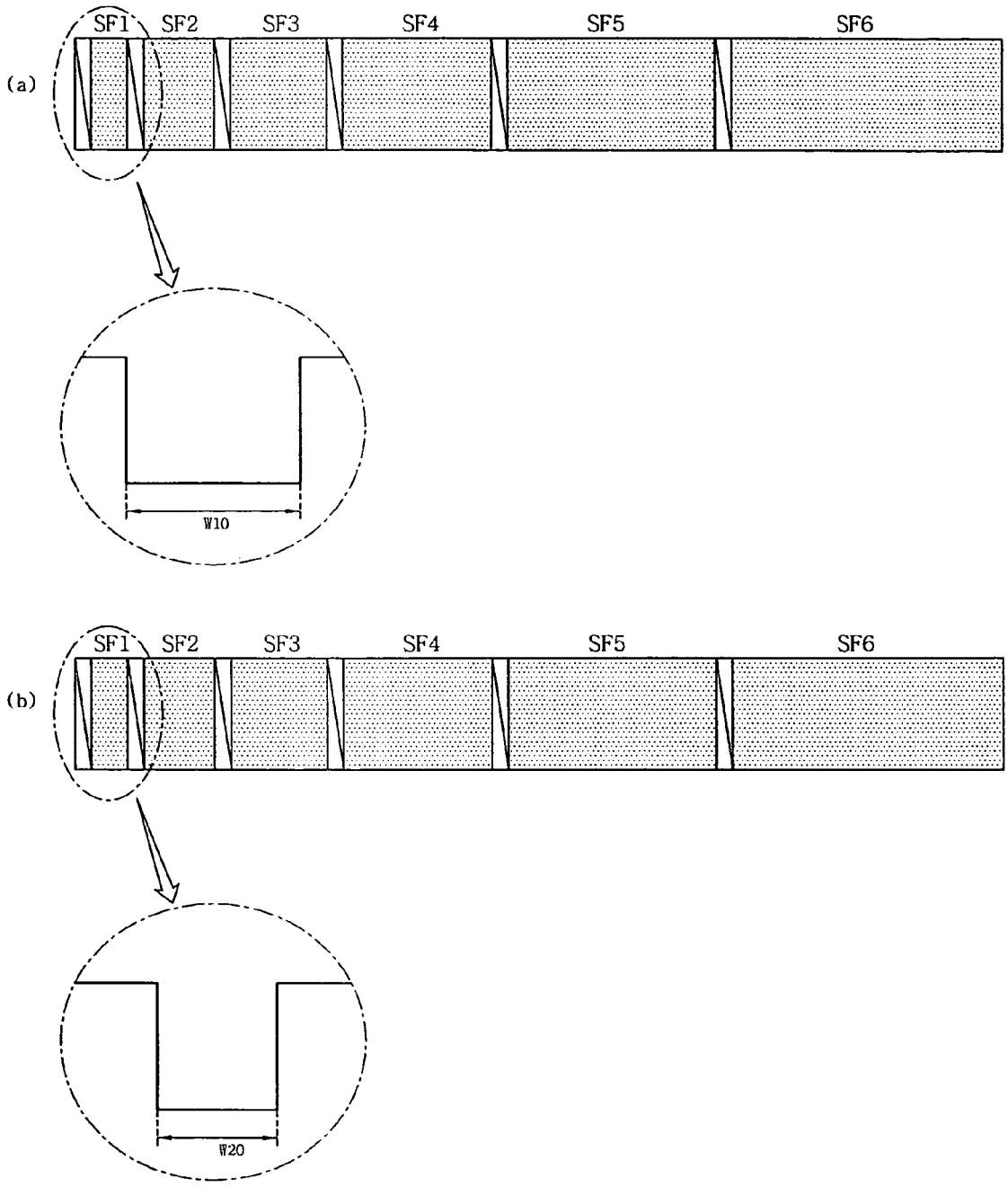
FIG. 12 illustrates another implementation of a method for differently controlling a time duration of an address period.

FIG. 12 illustrates another implementation of a method for differently controlling the time duration of the address period.

Referring to FIG. 12, (a) illustrates a first frame, and (b) illustrates a second frame. The first frame comprises a first subfield (SF1) comprising a first scan signal. The second frame comprises a second subfield (SF2) comprising a second scan signal. A gray level weight of the first subfield is substantially equal to that of the second subfield.

In this case also, as shown, a width (W20) of the second scan signal can be differentiated from a width (W10) of the first scan signal.

FIG. 12 illustrates that a width of the scan signal is differently controlled only in the first subfield among the subfields of the frame. Unlike this, it is also possible to differently control the width of the scan signal in predetermined one or more subfields among the subfields of the frame.

The width of the scan signal is relatively greatly controlled as in (a) when the plasma display panel 100 relatively high increases in temperature.

In other words, when the plasma display panel 100 is relatively high in temperature, the width of the scan signal is relatively great, thereby stabilizing the address discharge.

The above illustrates only a case that only one scan signal is supplied to the scan electrode (Y) during the address period of one subfield. However, it is also possible to supply a plurality of scan signals during the address period of one subfield. This will be described with reference to accompanying FIG. 13 below.

Figure 13:
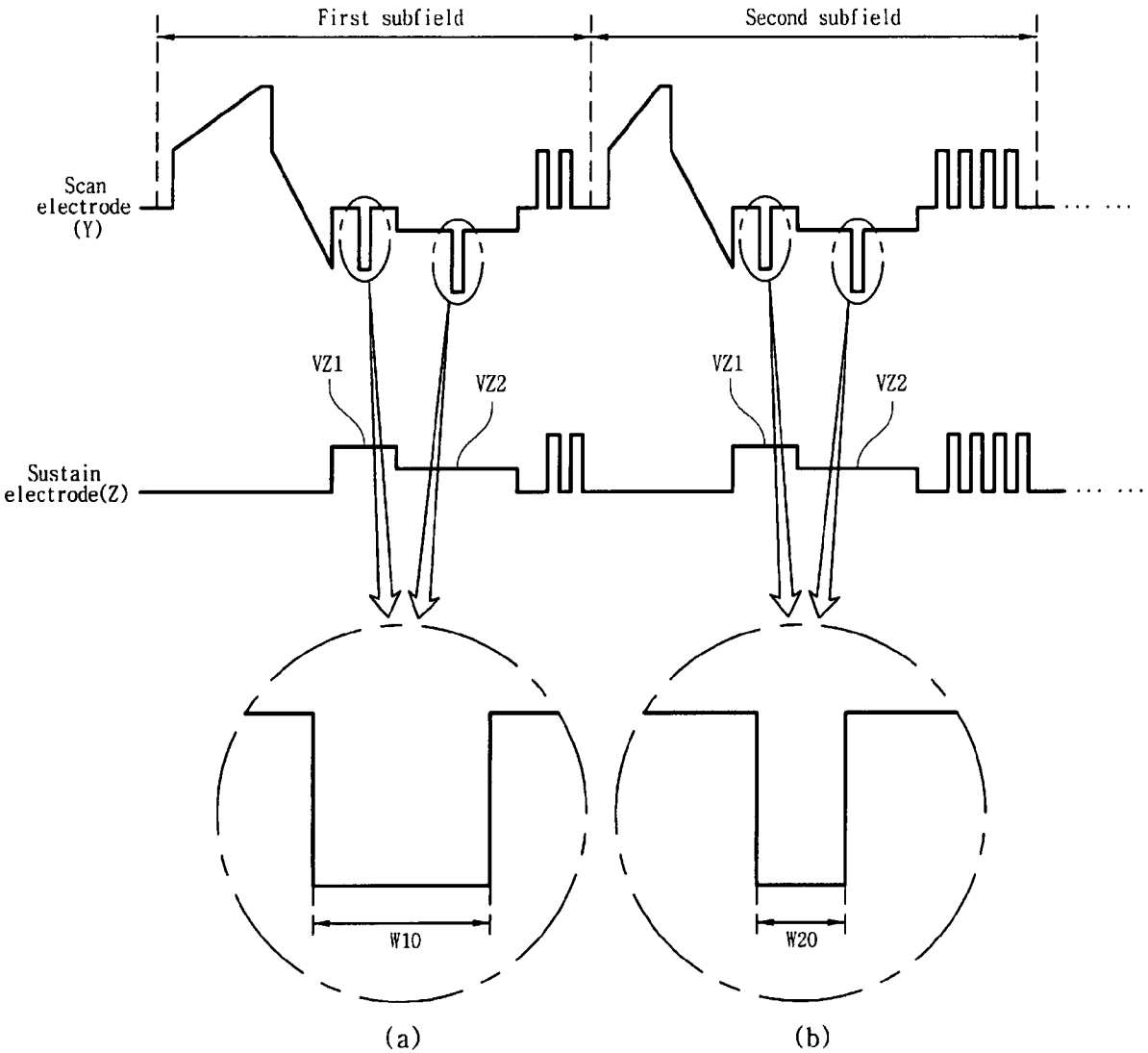
FIG. 13 illustrates the number of scan signals supplied to a scan electrode in an address period of one subfield.

FIG. 13 illustrates the number of scan signals supplied to the scan electrode during the address period of one subfield.

Referring to FIG. 13, in case where the first scan signal supplied to the scan electrode (Y) during the first address period of the first subfield and the second scan signal supplied to the scan electrode (Y) during the second address period of the second subfield are plural, the widths (W10) of the plurality of first scan signals can be differentiated from the widths (W20) of the plurality of second scan signals.

In case where the plurality of scan signals is supplied to the scan electrode (Y) during the address period, it is suitable that the number of scan signals is two.

In a detailed description, the first scan signal and the second scan signal are different from each other in reference voltage that is a fall initiation voltage. More preferably, the reference voltage that is the fall initiation voltage of the second scan signal is lower than the reference voltage that is the fall initiation voltage of the first scan signal.

If the plurality of scan signals is supplied to the scan electrode (Y) during the address period of one subfield, a plurality of scan electrode (Y) lines can be scanned together.

In this case also, it is desirable to differentiate the widths of the scan signals from each other by W10 and W20, in the first subfield and the second subfield.

In case where the plurality of scan signals is supplied in one subfield, a first sustain bias signal (Vz1) and a second sustain bias signal (Vz2) having mutually different voltages can be supplied to the sustain electrode (Z).

Preferably, the voltage of the first sustain bias signal (Vz1) is higher than the voltage of the second sustain bias signal (Vz2).

The reason why the first sustain bias signal (Vz1) and the second sustain bias signal (Vz2) having the mutually different voltages are supplied to the sustain electrode (Z) is that the reference voltages that are the fall initiation voltages of the plurality of scan signals, that is, two scan signals are differentiated from each other. Thus, even though the plurality of scan signals is supplied in one subfield, the address discharge can be stabilized.

In this case, it is most suitable to employ a structure in which one scan electrode (Y) line is provided commonly to upper and lower discharge cell lines among a plurality of discharge cell lines. However, the present invention is not limited only to the above structure, and is applicable even when the scan electrode (Y) is not commonly provided to the upper and lower discharge cell lines.

As above, the method for differently controlling the time duration of the reset period or the time duration of the address period is described. A case of differently controlling the time duration of the sustain period will be described below.

Figure 14A:
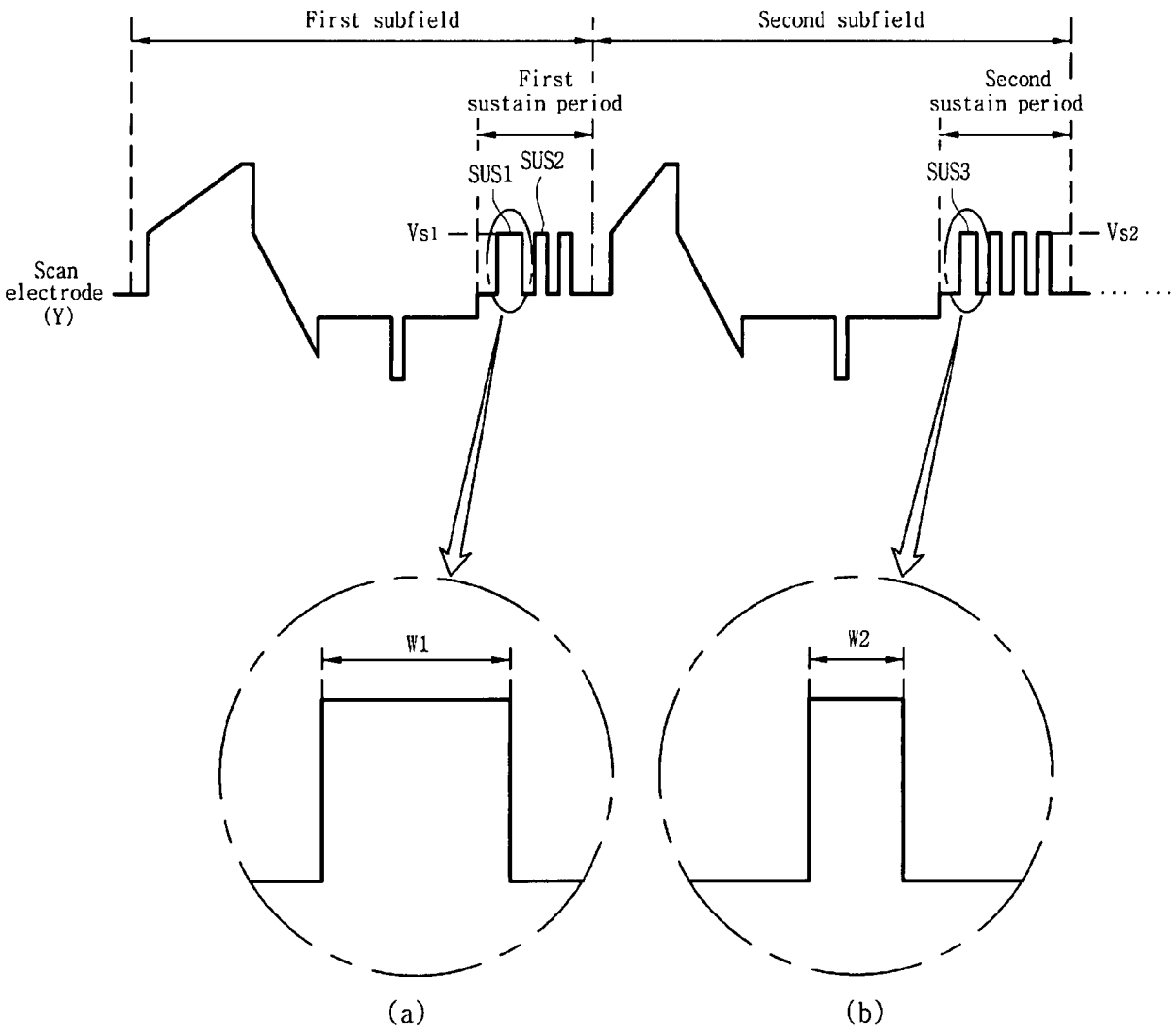
FIGS. 14A to 14C illustrate an implementation of a method for controlling a width of at least one sustain signal and differently controlling a time duration of a sustain period.
Figure 14B:
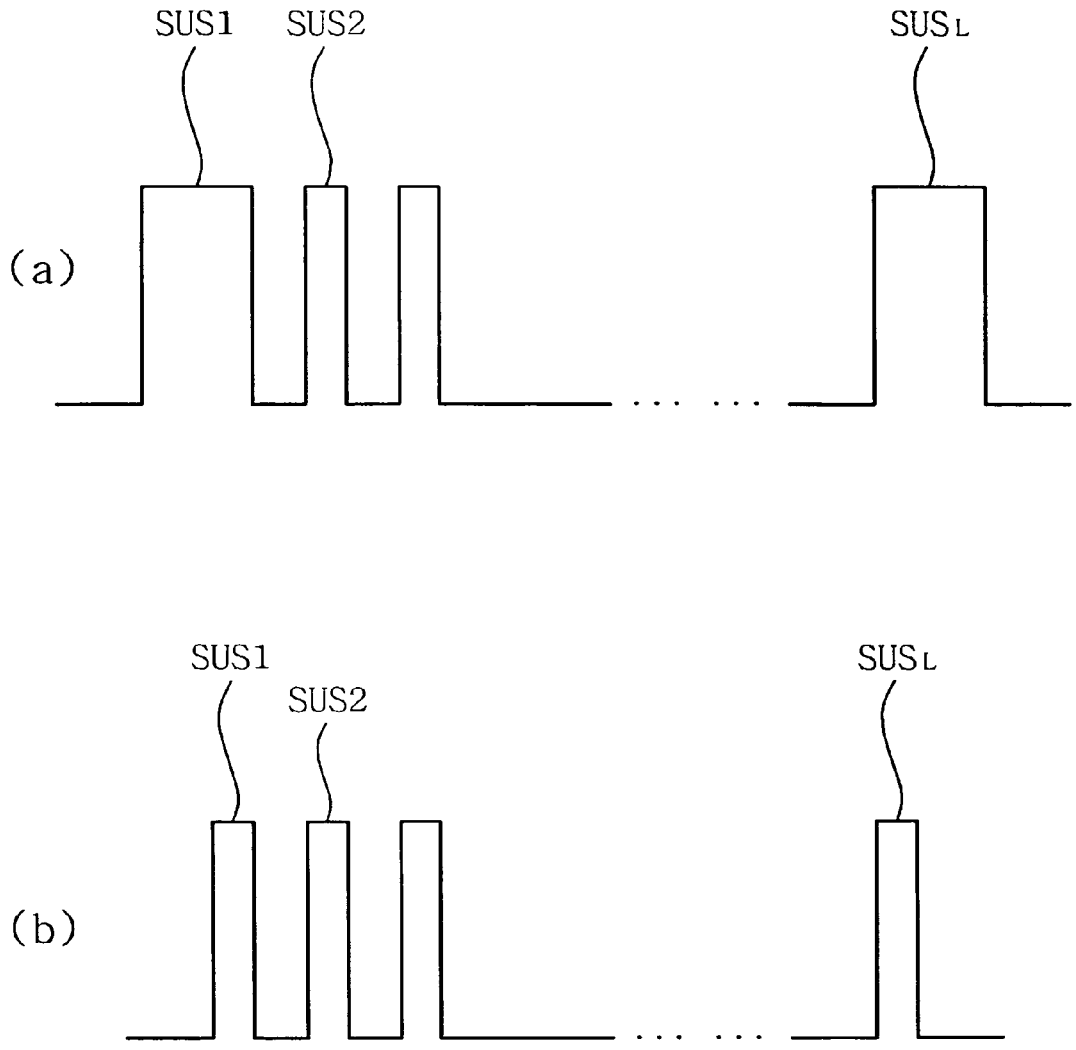

FIGS. 14A and 14B illustrate an implementation of a method for controlling a width of at least one sustain signal and differently controlling a time duration of the sustain period.

As shown in FIG. 14A, in case where the number of first sustain signals supplied to the scan electrode (Y) during the first sustain period of the first subfield and the number of second sustain signals supplied to the scan electrode (Y) during the second sustain period of the second subfield are plural, a width of at least one of the first sustain signals can be differentiated from a width of at least one of the second sustain signals, thereby differentiating a time duration of a first sustain period of the first subfield (SF1) among the subfields of the frame, from a time duration of a second sustain period of the second subfield (SF2).

In a more detailed description, a width of a first sustain signal (SUS1) supplied during the sustain period of the first subfield is "W1", and a width of a first sustain signal (SUS3) supplied during the sustain period of the second subfield is "W2" less than the "W1".

Together, the width of the first sustain signal (SUS1) supplied during the sustain period of the first subfield is greater than the width of the second sustain signal (SUS2). If the width of the first sustain signal (SUS1) is relatively great as above, an amount of wall charges within the discharge cell at an initial time of the sustain period can be sufficiently guaranteed, thereby allowing the sustain discharge smooth and stable.

The above illustrates that the sustain signal is supplied only to the scan electrode (Y). Unlike this, the sustain signal can be supplied to the scan electrode (Y) and/or the sustain electrode (Z).

It is desirable that a gray level weight of the first subfield is relatively smaller than that of the second subfield.

The reason why the width of at least one sustain signal supplied to the scan electrode (Y) during the sustain period of the subfield having the relatively smaller gray level weight gets greater is that the number of the sustain signals supplied during the sustain period is relatively small in the subfield having the relatively smaller gray level weight and thus, the possibility of the unstable discharge is relatively greater.

In other words, in the subfield having the relatively smaller gray level weight, in which the number of the sustain signals is relatively small and thus, the possibility of the unstable discharge is relatively great, the width of at least one sustain signal can be greater, thereby preventing the reset discharge from being unstabilized even when the total lead contents are set to 1000 PPM or less.

A maximum voltage (Vs1) of the first sustain signal and a maximum voltage (Vs2) of the second sustain signal can range from 150V to 250V.

The reason why the maximum voltage (Vs1) of the first sustain signal and the maximum voltage (Vs2) of the second sustain signal are 150V or more is to suitably induce the sustain discharge during the sustain period.

The reason why the maximum voltage (Vs1) of the first sustain signal and the maximum voltage (Vs2) of the second sustain signal are 250V or less is to suitably induce the sustain discharge while suitably sustaining even a luminance, and prevent a switching element disposed in the driver from being damaged due to an excessively great voltage.

Referring next to FIG. 14B, unlike FIG. 14A, widths of a first sustain signal (SUS1) and a last sustain signal (SUSL) can be greater than those of other sustain signals.

Together, it is also possible that the widths of the first sustain signal (SUS1) and the last sustain signal (SUSL) relatively get greater in a first subfield of (a), and the widths of all the sustain signals substantially get identical in a second subfield of (b).

The width of the sustain signal supplied during the sustain period can be controlled as above, thereby differently controlling the time duration of the whole sustain period.

Figure 14C:
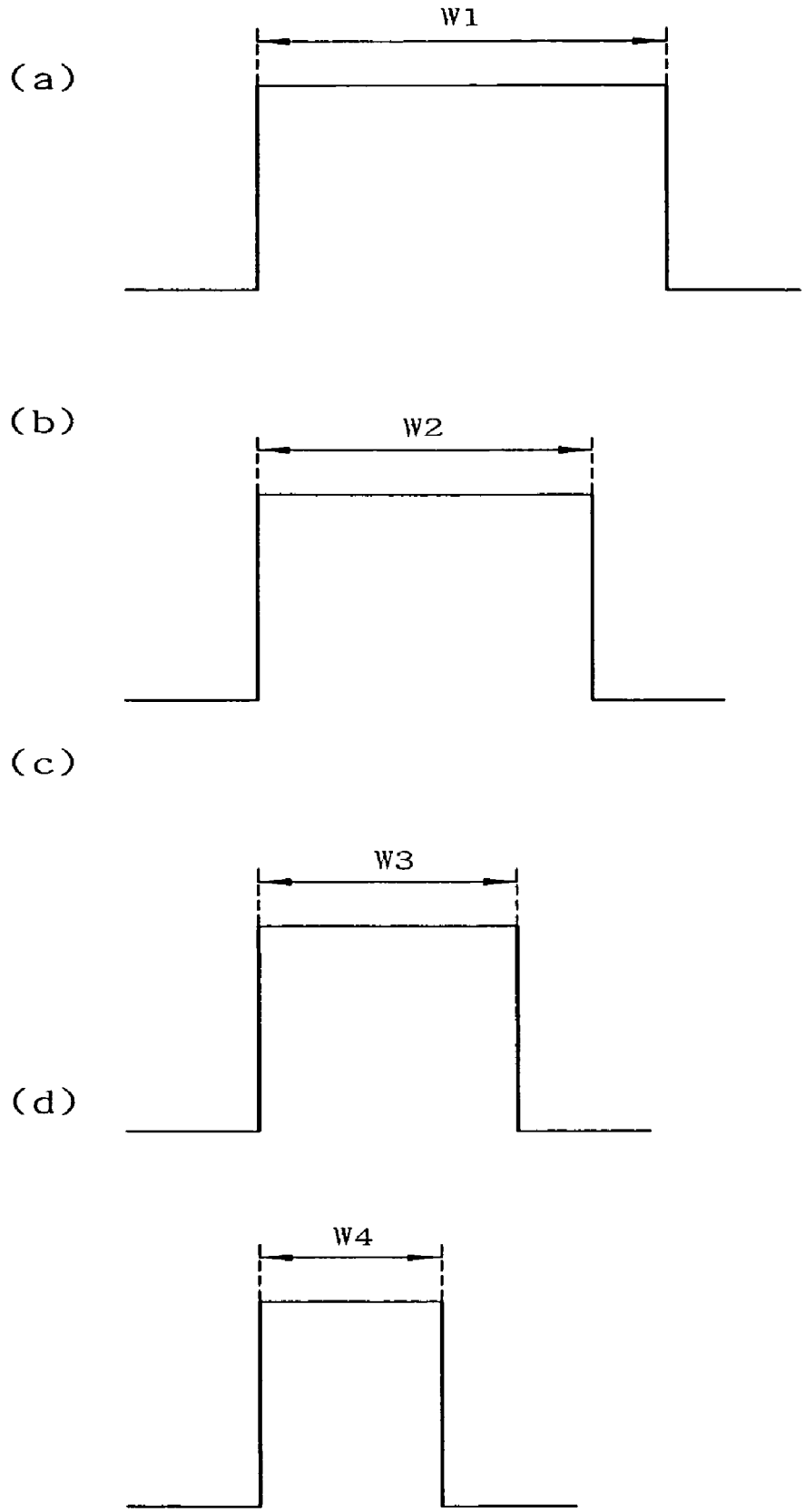

Referring next to FIG. 14C, an average width of the sustain signal is "W1" in a first subfield of (a), an average width of the sustain signal is "W2" less than the "W1" in a second subfield of (b), an average width of the sustain signal is "W3" less than the "W2" in a third subfield of (c), and an average width of the sustain signal is "W4" less than the "W3" in a fourth subfield of (d).

As such, the width of the sustain signal can be variously controlled depending on the gray level weight of the subfield.

Figure 15:
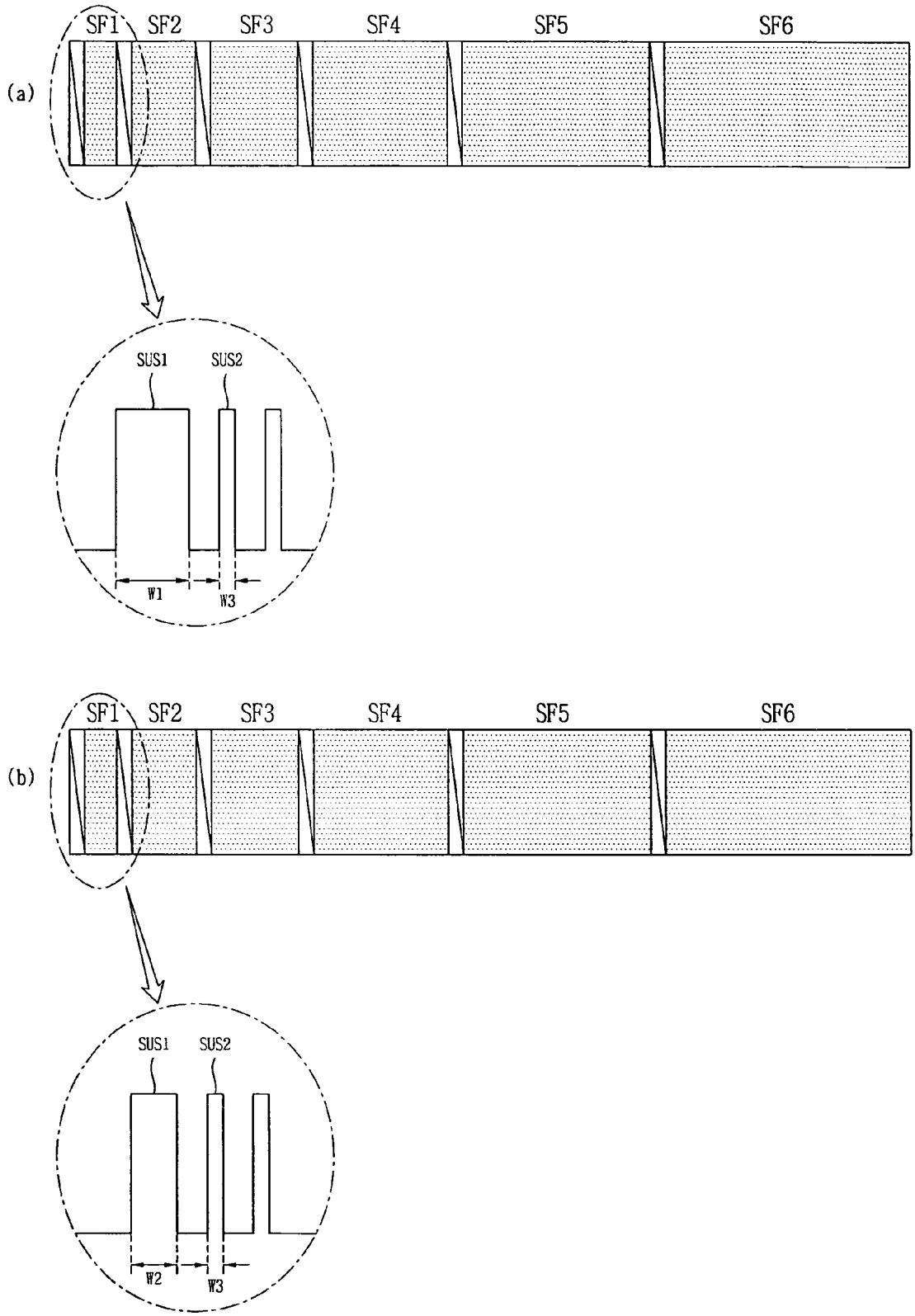
FIG. 15 illustrates another implementation of a method for controlling a width of at least one sustain signal and differently controlling a time duration of a sustain period.

FIG. 15 illustrates another implementation of a method for controlling the width of at least one sustain signal and differently controlling the time duration of the sustain period.

Referring to FIG. 15, at least one subfield of the frame is different from a subfield, which has the substantially same gray level weight, of the frame where at least one sustain signal supplied during the sustain period has a different width.

For example, in a first frame of (a), in a first subfield, a width of a first sustain signal (SUS2) is "W1" and a width of a second sustain signal (SUS2) is "W3", whereas, in a second frame of (b), in a first subfield having the substantially same gray level weight as the first subfield of the (a), a width of a first sustain signal (SUS1) is set to "W2" less than that of the (a), and a width of a second sustain signal (SUS2) is set to "W3".

FIG. 15 illustrates that the width of the sustain signal is differently controlled only in the first subfield among the subfields of the frame. Unlike this, it is also possible to differently control the width of at least one sustain signal in predetermined one or more subfields among the subfields of the frame.

The width of at least one sustain signal is relatively greatly controlled as in the (a) when the plasma display panel 100 relatively high increases in temperature.

In other words, when the plasma display panel 100 relatively high increases in temperature, the width of at least one sustain signal is relatively greatly controlled, thereby preventing a reduction of the driving efficiency.

The above describes the method for differently controlling the width of at least one sustain signal. Unlike this, it is also possible to control the number of the sustain signals. This will be described below.

Figure 16:
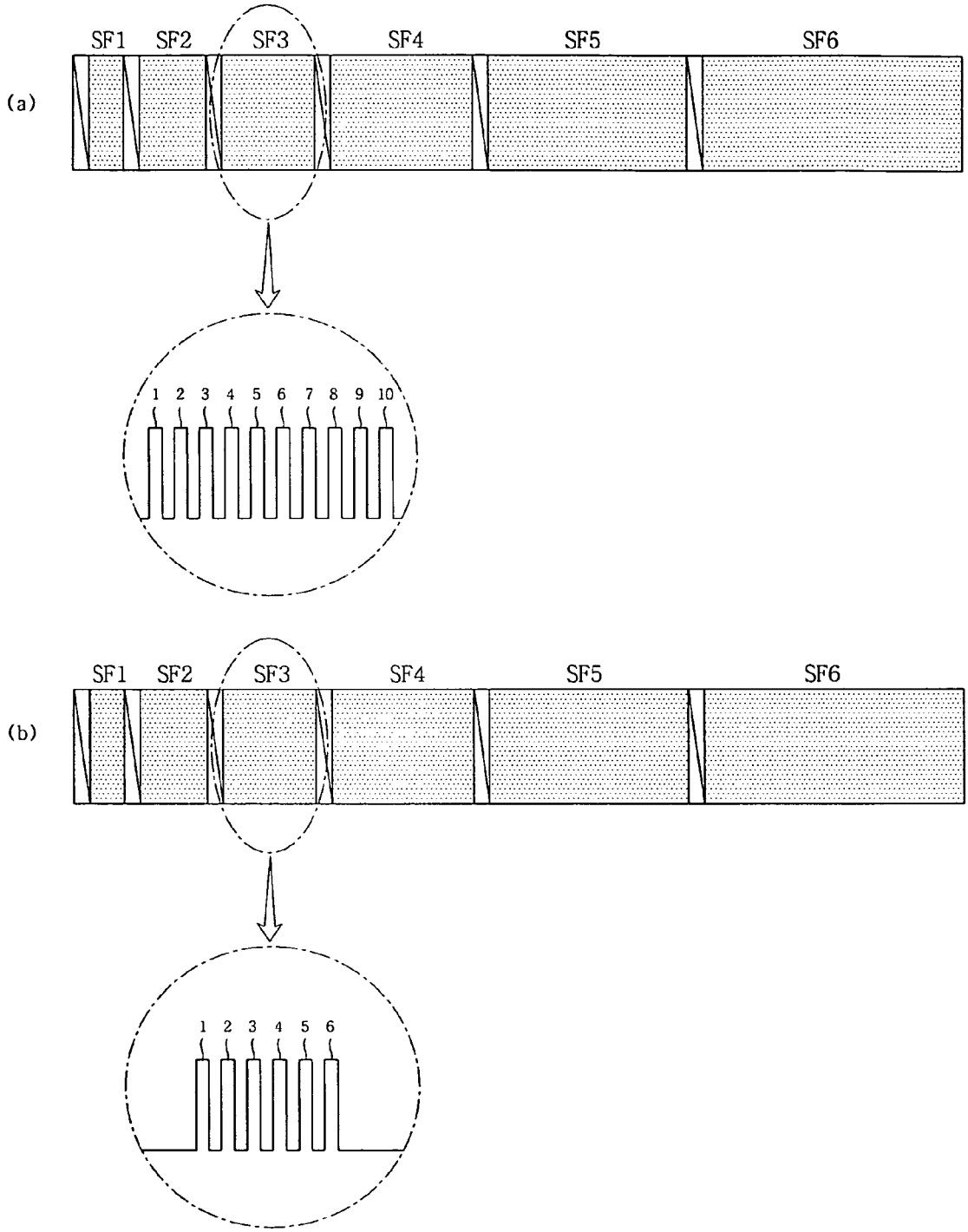
FIG. 16 illustrates an implementation of a method for controlling the number of sustain signals and differently controlling a time duration of a sustain period.

FIG. 16 illustrates an implementation of a method for controlling the number of the sustain signals and differently controlling the time duration of the sustain period.

As shown in FIG. 16, an n-th subfield of a first frame comprises a first subfield, an n-th subfield of a second frame comprises a second subfield, and the number of first sustain signals supplied to the scan electrode (Y) during the first sustain period can be differentiated from the number of second sustain signals supplied to the scan electrode (Y) during the second sustain period.

For example, in the first frame of the (a), in the third subfield (SF3), the number of the sustain signals can be set to ten, whereas, in the second frame of the (b), in the third subfield (SF3), the number of the sustain signals can be set to six less than that of the (a).

The third subfield (SF3) of the (a) and the third subfield (SF3) of the (b) mean that relative gray level weights within the respective frames are substantially equal to each other.

The frames of the (a) and (b) are frames for the substantially same image. Preferably, an average power level (APL) of the first frame of the (a) is substantially equal to that of the second frame of the (b).

FIG. 16 illustrates that the number of the sustain signals is differently controlled only in the third subfield (SF3) among the subfields of the frame. Unlike this, it is also possible to differently control the number of the sustain signals at predetermined one or more sustain signals among the subfields of the frame.

The number of the sustain signals is relatively greatly controlled as in the (a) when the plasma display panel 100 relatively high increases in temperature.

In other words, when the plasma display panel 100 is relatively high in temperature, the number of the sustain signals is relatively more, thereby stabilizing the sustain discharge.

More various implementations can be provided in addition to several implementations.

For example, up slopes of the setup signals can be equal to each other and maximum voltages of the setup signals can be differentiated from each other, or the falling slopes of the setdown signals can be equal to each other and the minimum voltages of the setdown signals can be differentiated from each other, thereby differentiating the time durations of the reset periods from each other. Also, the voltage of the reset signal can be partially relatively longer sustained, thereby differentiating the time durations of the reset periods from each other.

Other implementations are within the scope of the following claims.

What is claimed is:

1. A method for driving a plasma display panel having a scan electrode, a dielectric layer, and a protective layer, the method comprising:

supplying a first driving signal to the scan electrode in a first subfield during a first reset period for initializing a discharge cell, a first address period for scanning the discharge cell, and a first sustain period for sustaining a discharge of the discharge cell; and supplying a second driving signal different from the first driving signal to the scan electrode in a second subfield during a second reset period having a different time duration from the first reset period, a second address period having a different time duration from the first address period, and a second sustain period having a different time duration from the first sustain period, wherein at least one of the dielectric layer or the protective layer comprise 1000 PPM (parts per million) or less of lead (pb), wherein a width of a first scan signal supplied to the scan electrode during the first address period of the first subfield is different from a width of the second scan signal supplied to the scan electrode during the second address period of the second subfield, and wherein a first frame includes the first subfield having the first scan signal, and a second frame includes the second subfield having the second scan signal, and a gray level weight of the first subfield is substantially equal to gray level weight of the second subfield.

2. The method of claim 1, wherein the first subfield is at least one of a plurality of subfields, and the second subfield is at least one of the plurality of the subfields other than the subfields of the first subfield.

3. The method of claim 1, wherein a width of a first reset signal of the first driving signal supplied to the scan electrode during the first reset period is different from a width of a second reset signal of the second driving signal supplied to the scan electrode during the second reset period.

4. The method of claim 3, wherein a width of a first setup signal of the first reset signal is different from a width of a second setup signal of the second reset signal.

5. The method of claim 4, wherein maximum voltages of the first setup signal and the second setup signal range from 250V to 350V.

6. The method of claim 3, wherein a width of a first setdown signal of the first reset signal is different from a width of a second setdown signal of the second reset signal.

7. The method of claim 6, wherein minimum voltages of the first setdown signal and the second setdown signal range from −210V to −140V.

8. The method of claim 1, wherein a number of first reset signals supplied to the scan electrode during the first reset period of the first subfield is different from a number of second reset signals supplied to the scan electrode during the second reset period of the second subfield.

9. The method of claim 1, wherein a second reset signal supplied to the scan electrode during the second reset period of the second subfield comprises either a setup signal and a setdown signal or a bias signal sustained at a first voltage.

10. The method of claim 1, wherein a second reset signal supplied to the scan electrode during the second reset period of the second subfield includes a bias signal sustained at a first voltage that is substantially equal to a scan reference voltage supplied to the scan electrode during the second address period of the second subfield.

11. The method of claim 9, wherein a plurality of sustain signals are supplied to a sustain electrode during the second sustain period of the second subfield, and a first sustain signal from among the plurality of second sustain signals supplied to the scan electrode during the second sustain period of the second subfield overlaps with a first sustain signal from among the plurality of sustain signals supplied to the sustain electrode.

12. The method of claim 1, wherein a second reset signal supplied to the scan electrode during the second reset period of the second subfield includes a bias signal sustained at a first voltage, and a falling slope of a last sustain signal from among a plurality of sustain signals supplied to the scan electrode in a subfield earlier than the second subfield is substantially equal to a falling slope of the setdown signal supplied to the scan electrode during a setdown period.

13. The method of claim 1, wherein minimum voltages of the first scan signal and the second scan signal range from −250V to −150V.

14. The method of claim 1, wherein a number of first scan signals and a number of second scan signals are plural, and a width of each of the first scan signals is different from a width of each of the second scan signals.

15. The method of claim 1, wherein a number of first sustain signals supplied to the scan electrode during the first sustain period of the first subfield and a number of second sustain signals supplied to the scan electrode during the second sustain period of the second subfield are plural, and a width of at least one of the first sustain signals is different from a width of at least one of the second sustain signals.

16. The method of claim 1, wherein an n-th subfield of a first frame comprises the first subfield, and an n-th subfield of a second frame comprises the second subfield, and a number of first sustain signals supplied to the scan electrode during the first sustain period is different from a number of second sustain signals supplied to the scan electrode during the second sustain period.

17. The method of claim 1, wherein maximum voltages of a first sustain signal and a second sustain signal range from 150V to 250V.

18. The method of claim 15, wherein a time duration of the first sustain period of the first subfield is different from a time duration of the second sustain period of the second subfield.

19. The method of claim 15, wherein a width of a leading one of the sustain pulses applied during the first sustain period of the first subfield is different from a width of a leading one of the sustain pulses applied during the second sustain period of the second subfield.

20. The method of claim 19, wherein the width of the leading one of the sustain pulses applied during the first sustain period of the first subfield is greater than the width of the leading one of the sustain pulses applied during the second sustain period of the second subfield, and wherein the gray level weight of the first subfield is lower than the gray level weight of the second subfield.

21. The method of claim 15, wherein widths of first and last sustain signals applied to the scan electrode during the first sustain period of the first subfield are different from widths of other sustain signals applied to the scan electrode during the first sustain period of the first subfield.

22. The method of claim 15, wherein widths of first and last sustain signals applied to the scan electrode during the first sustain period of the first subfield are different from widths of sustain signals applied to the scan electrode during the second sustain period of the second subfield.

23. The method of claim 22, wherein the widths of first and last sustain signals applied to the scan electrode during the first sustain period of the first subfield are greater than widths of sustain signals applied to the scan electrode during the second sustain period of the second subfield, and wherein the gray level weight of the first subfield is lower than the gray level weight of the second subfield.

24. The method of claim 15, wherein an average width of sustain pulses applied during the first sustain period of the first subfield is different from an average width of sustain pulses applied during the second sustain period of the second subfield.

25. The method of claim 15, wherein an average width of sustain pulses applied during the first sustain period of the first subfield is greater than an average width of sustain pulses applied during the second sustain period of the second subfield, and wherein the gray level weight of the first subfield is lower than the gray level weight of the second subfield.

26. The method of claim 15, wherein a leading one of the sustain pulses applied to the scan electrode during the first sustain period of the first subfield overlaps a leading one of the sustain pulses applied to an address electrode during the first sustain period of the first subfield.

* * * * *